US009183691B2

(12) United States Patent
Nemoto

(10) Patent No.: US 9,183,691 B2
(45) Date of Patent: Nov. 10, 2015

(54) BANKNOTE PAY-IN/PAY-OUT DEVICE AND BANKNOTE PROCESSING MACHINE

(71) Applicant: Oki Electric Industry Co., Ltd., Tokyo (JP)

(72) Inventor: Yukihiro Nemoto, Tokyo (JP)

(73) Assignee: OKI ELECTRIC INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 14/363,881

(22) PCT Filed: Nov. 9, 2012

(86) PCT No.: PCT/JP2012/079165

§ 371 (c)(1),
(2) Date: Jun. 9, 2014

(87) PCT Pub. No.: WO2013/088876

PCT Pub. Date: Jun. 20, 2013

(65) Prior Publication Data

US 2014/0326575 A1 Nov. 6, 2014

(30) Foreign Application Priority Data

Dec. 13, 2011 (JP) ..... 2011-272216

(51) Int. Cl.
*G07D 11/00* (2006.01)

(52) U.S. Cl.
CPC ..... *G07D 11/0084* (2013.01); *G07D 11/0018* (2013.01); *G07D 11/0081* (2013.01)

(58) Field of Classification Search
CPC ..... G07D 11/0018; G07D 11/0021; G07D 11/0033; G07D 11/0057; G07D 11/0081; G07D 11/0084; G07D 2211/00
USPC ..... 194/206, 207; 235/379; 209/534
See application file for complete search history.

(56) References Cited

U.S. PATENT DOCUMENTS

2002/0088850 A1 7/2002 Katou et al.
2008/0150224 A1 * 6/2008 Shimizu et al. ..... 271/263

FOREIGN PATENT DOCUMENTS

| | | | |
|---|---|---|---|
| JP | 2000-020783 | A | 1/2000 |
| JP | 2002-056435 | A | 2/2002 |
| JP | 2002-260061 | A | 9/2002 |
| JP | 2006-209580 | A | 8/2006 |
| JP | 2008-027023 | A | 2/2008 |

* cited by examiner

*Primary Examiner* — Mark Beauchaine
(74) *Attorney, Agent, or Firm* — Rabin & Berdo, P.C.

(57) ABSTRACT

A banknote pay-in/pay-out device and a banknote processing machine having a simpler pay-in/pay-out port section mechanism than hitherto. During paying in, out of banknotes inserted into a pay-in/pay-out port section, a pay-in reject banknote that has been determined to be unsuitable for paying in is conveyed to a sorting conveyance path, and temporarily retained in the sorting conveyance path. So doing enables, for example, the pay-in reject banknote to be temporarily retained in the sorting conveyance path until, for example, pay-in counting processing has been completed, with the pay-in reject banknote being replaced in the pay-in/pay-out port section to be returned to a user after the pay-in counting processing has been completed, without providing a partitioning plate to the pay-in/pay-out port section as hitherto.

12 Claims, 38 Drawing Sheets

BANKNOTE PAY-IN/PAY-OUT DEVICE AND BANKNOTE PROCESSING MACHINE

TECHNICAL FIELD

The present invention relates to a banknote pay-in/pay-out device and a banknote processing machine, and is, for example, suitable for application to a banknote pay-in/pay-out device installed in an automated teller machine.

BACKGROUND ART

Related automated teller machines are installed with banknote pay-in/pay-out devices that perform processing related to pay-in and pay-out of banknotes. A banknote pay-in/pay-out device is configured with, for example, a pay-in/pay-out port section that accepts and dispenses banknotes for a customer, a classification section that classifies the denomination and authenticity of an inserted banknote, a temporary holding section that temporarily holds inserted banknotes, and banknote storage boxes that store banknotes by denomination, as well as a conveyance path that links these sections together.

Such banknote pay-in/pay-out devices count inserted banknotes inserted by a user into the pay-in/pay-out port section when paying in. In such processing the banknote pay-in/pay-out device classifies the inserted notes, one note at a time, using the classification section. The banknote pay-in/pay-out device then stores and counts banknotes determined by the classification result to be normal banknotes in the temporary holding section, and banknotes (referred to as pay-in reject banknotes) determined to be banknotes that are unsuitable for paying in, are replaced in the pay-in/pay-out port section to be returned to the user.

Then, when the user has approved the pay-in amount, the banknote pay-in/pay-out device uses the classification section to re-determine the banknotes (normal banknotes) stored in the temporary holding section, before housing the banknotes by denomination in the respective banknote storage boxes.

In related banknote pay-in/pay-out devices, a slidable partitioning plate is provided in a banknote storage space of the pay-in/pay-out port section as a mechanism for returning pay-in reject banknotes from the pay-in/pay-out port section to the user. In related banknote pay-in/pay-out devices, the partitioning plate partitions the banknote storage space into a pay-in space and a pay-out space.

When returning pay-in reject banknotes to the user, the banknote pay-in/pay-out device slides the partitioning plate so as to enlarge the pay-out space, and the pay-in reject banknotes are replaced in the pay-out space to be returned to the user (see for example Japanese Patent Application Laid-Open (JP-A) No. 2002-260061).

DISCLOSURE OF INVENTION

Technical Problem

However, there is an issue that providing the slidable partitioning plate in the pay-in/pay-out port section and sliding the partitioning plate as described above leads to a more complicated pay-in/pay-out port section mechanism.

In consideration of this issue, the present invention proposes a banknote pay-in/pay-out device and a banknote processing machine capable of achieving a simpler pay-in/pay-out port section mechanism than hitherto.

Solution to Problem

In order to address the above issue, a first aspect of the invention is a banknote pay-in/pay-out device including: a pay-in/pay-out port section that configures a pay-in port and a pay-out port for banknotes; a classification section that classifies banknotes; a banknote storage box that, out of banknotes inserted into the pay-in/pay-out port section, stores any normal banknotes determined by the classification section to be normal; and a temporary retention section that is provided separately to the pay-in/pay-out port section, and that, out of banknotes inserted into the pay-in/pay-out port section, temporarily retains any pay-in reject banknotes determined by the classification section to be unsuitable for paying in, wherein any pay-in reject banknotes that the classification section has determined to be unsuitable for paying in are temporarily retained in the temporary retention section prior to being replaced in the pay-in/pay-out port section and returned.

A second aspect of the invention is a banknote processing machine including: a banknote pay-in/pay-out device that includes a pay-in/pay-out port section that configures a pay-in port and a pay-out port for banknotes, a classification section that classifies banknotes, a banknote storage box that, out of banknotes inserted into the pay-in/pay-out port section, stores any normal banknotes determined by the classification section to be normal, and a temporary retention section that is provided separately to the pay-in/pay-out port section, and that, out of banknotes inserted into the pay-in/pay-out port section, temporarily retains any pay-in reject banknotes determined by the classification section to be unsuitable for paying in, wherein any pay-in reject banknotes that the classification section has determined to be unsuitable for paying in are temporarily retained in the temporary retention section prior to being replaced in the pay-in/pay-out port section and returned.

In the above aspects, a pay-in reject banknote can be retained in the temporary retention section until, for example, classification of banknotes inserted into the pay-in/pay-out port section has been completed, and the pay-in reject banknote can then be replaced in the pay-in/pay-out port section to be returned to a user after classification has been completed, without providing a slidable partitioning plate to the pay-in/pay-out port section.

Advantageous Effects of Invention

According to the present invention, a pay-in reject banknote can be replaced in the pay-in/pay-out port section to be returned to a user, for example after classification of banknotes inserted into the pay-in/pay-out port section has been completed, without providing a slidable partitioning plate to the pay-in/pay-out port section. A banknote pay-in/pay-out device and a banknote processing machine can accordingly be achieved with a simpler pay-in/pay-out port section mechanism than hitherto.

BEST MODE FOR CARRYING OUT THE INVENTION

Detailed explanation follows regarding exemplary embodiments of the present invention, with reference to the drawings.

1. First Exemplary Embodiment

1-1. Automated Teller Machine (ATM) Configuration

Figure 1:
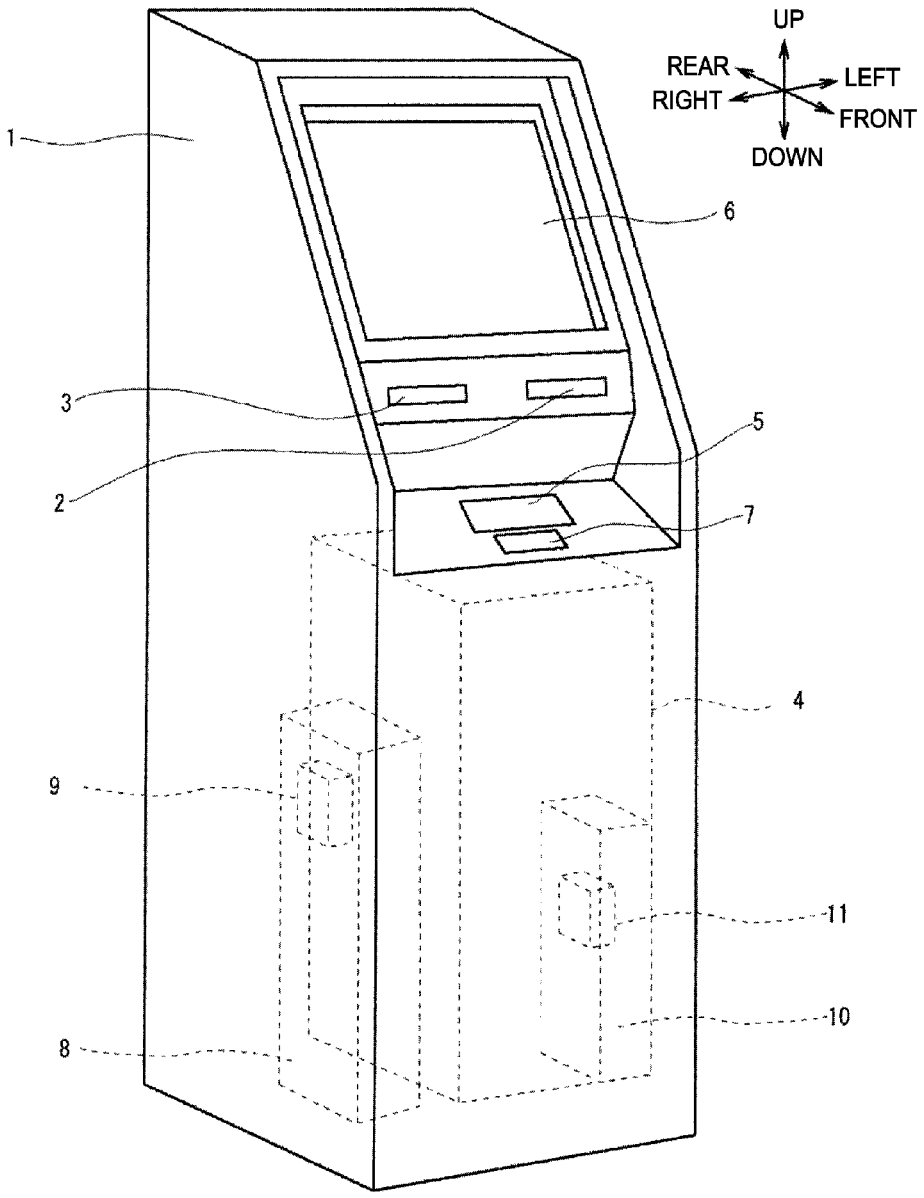
FIG. 1 is schematic diagram illustrating a configuration of an ATM.

Explanation is first given regarding a first exemplary embodiment. FIG. 1 schematically illustrates an overall configuration of an automated teller machine (also referred to below as an ATM) 1 as an example of a banknote processing machine of the first exemplary embodiment.

The ATM 1 performs processing such as cash deposits and withdrawals, as well as bank transfers, under operation by a user with transaction media such as a cash card, banknotes, and transaction slips.

An interior upper section of the ATM 1 is provided with a card processing device (not illustrated in the drawings) that processes a cash card or the like belonging to the user, and a receipt printer (not illustrated in the drawings) that prints and issues the user with a transaction slip (also referred to below as a receipt).

The card processing device processes a cash card belonging to the user that is inserted through a card insertion/return port 2 provided to a front face (a face that faces the user) of the ATM 1. The receipt printer supplies the transaction slip to the user through a receipt issue port 3 provided to the front face of the ATM 1.

An interior lower section of the ATM 1 is provided with a banknote pay-in/pay-out device 4 that processes banknotes. A pay-in/pay-out port shutter 5 that is exposed at the front face of the ATM 1 is provided above a front face of the pay-in/pay-out device 4. Banknotes are paid in and paid out according to opening and closing of the pay-in/pay-out port shutter 5.

The front face of the ATM 1 is moreover provided with an operation display section 6, that displays details of the user's transaction and is input with various information and items relating to a transaction, and a ten-key 7 that is used to input a PIN number or the like.

A main controller 8 that performs overall control of the ATM 1 as well as controlling each of the sections described above, and a memory section 9 that stores, for example, operation data of the ATM 1, are provided inside the ATM.

Separately to the main controller 8 and the memory section 9, a controller 10 that controls the banknote pay-in/pay-out device 4, and a memory section 11 configuring a storage region of the controller 10, are provided inside the banknote pay-in/pay-out device 4.

1-2. Banknote Pay-In/Pay-Out Device Configuration

Figure 2:
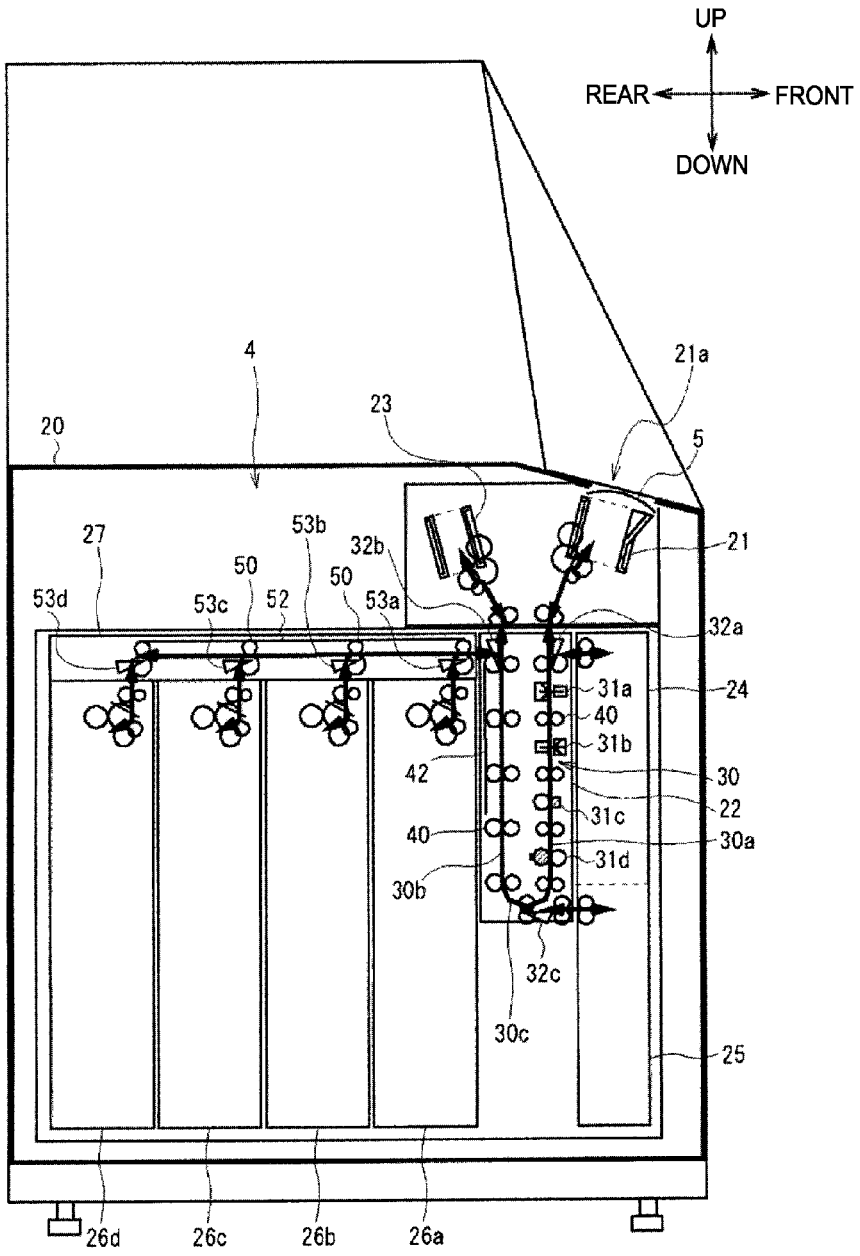
FIG. 2 is a schematic diagram illustrating a configuration of a banknote pay-in/pay-out device of a first exemplary embodiment.

Next, explanation is given regarding internal configuration of the banknote pay-in/pay-out device 4, with reference to FIG. 2. The banknote pay-in/pay-out device 4 is provided inside a safe section 20 that is enclosed by thick steel plates provided inside the ATM 1.

A pay-in/pay-out port section 21 for insertion and removal of banknotes by the user is disposed above a front face of the banknote pay-in/pay-out device 4 (the face that faces the user). A pay-in/pay-out port 21*a*, that serves as an example of a pay-in port and a pay-out port of the pay-in/pay-out port section 21, is provided with the pay-in/pay-out port shutter 5 described above.

The banknote pay-in/pay-out device 4 opens the pay-in/pay-out port shutter 5 to expose the pay-in/pay-out port section 21 from the front face of the ATM 1, enabling the user to insert banknotes or remove banknotes.

A classification section 22, that determines, for example, the authenticity, physical condition, denomination, and conveyance state of a banknote, is disposed below the pay-in/pay-out port section 21. The pay-in/pay-out port section 21 is capable of connecting with the classification section 22.

A temporary holding section 23, that temporarily stores banknotes paid in by the user until successful completion of a transaction, is disposed to the rear of the pay-in/pay-out port section 21 and above the classification section 22. The temporary holding section 23 is also capable of connecting with the classification section 22.

A reject box 24 and a retrieval box 25 are disposed in front of the classification section 22, and are stacked top-to-bottom, with the reject box 24 on the upper side and the retrieval box 25 on the lower side. The reject box 24 stores banknotes (also referred to as pay-out reject banknotes) that have been determined to be banknotes that are unsuitable for paying out to the user. The retrieval box 25 stores banknotes left behind by the user in the pay-in/pay-out port section 21. The reject box 24 and the retrieval box 25 are both capable of connecting with the classification section 22.

Plural (for example four) banknote storage boxes 26 (26*a* to 26*d*) that store banknotes by denomination are disposed to the rear of the classification section 22, in a row from front to rear.

A sorting conveyance path 27 that extends in a front-rear direction is disposed above the four banknote storage boxes 26 (26*a* to 26*d*) and to the rear of the classification section 22.

The sorting conveyance path 27 is capable of connecting with the classification section 22 and the respective banknote storage boxes 26 (26*a* to 26*d*). The sorting conveyance path 27 is moreover capable of conveying banknotes in either direction between the classification section 22 and the respective banknote storage boxes 26 (26*a* to 26*d*).

Namely, the sorting conveyance path 27 conveys banknotes to be stored in the banknote storage boxes 26 (26*a* to 26*d*) from the classification section 22 to the banknote storage boxes 26 (26*a* to 26*d*). The sorting conveyance path 27 also conveys banknotes to be paid out from the banknote storage boxes 26 (26*a* to 26*d*) to the user from the banknote storage boxes 26 (26*a* to 26*d*) to the classification section 22.

Note that in the banknote pay-in/pay-out device 4, the four banknote storage boxes 26 (26*a* to 26*d*) may be used for purposes other than as storage boxes that store banknotes by denomination. For example, one of the four banknote storage boxes 26 (26*a* to 26*d*) is set as a reject box for storing pay-out reject banknotes and used as a reject box.

Figure 3:
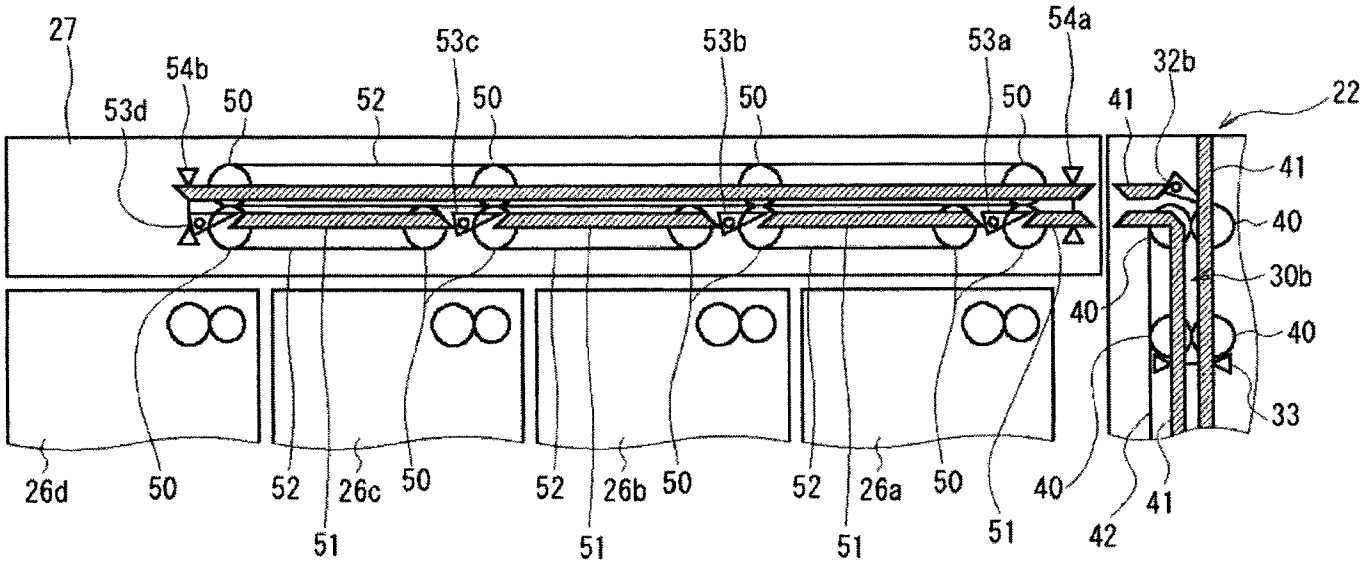
FIG. 3 is a schematic diagram illustrating a configuration of a classification section and a sorting conveyance path of a first exemplary embodiment.

More detailed explanation follows regarding configuration of the classification section 22 and the sorting conveyance path 27 of the banknote pay-in/pay-out device 4, with reference to FIG. 3 as well as FIG. 2. Note that portions that, out of FIG. 2 and FIG. 3, are only illustrated in FIG. 3 are followed by "(see FIG. 3)".

As illustrated in FIG. 2 and FIG. 3, the classification section 22 is configured by a conveyance path 30 that conveys banknotes, plural classification sensors 31 (31*a* to 31*d*) that classify banknotes passing on the conveyance path 30, plural conveyance path switching units 32 (32*a* to 32*c*) that switch a connection destination, and a conveyance state detection sensor 33 (see FIG. 3) that detects a banknote conveyance state.

The conveyance path 30 is a conveyance path that has an overall U-shape, and is configured by two parallel linear paths 30*a*, 30*b* that respectively extend in an up-down direction, and a circular arc shaped curved path 30*c* that links together lower ends of the two linear paths 30*a*, 30*b*. Note that the linear paths 30*a*, 30*b* are disposed in the front-rear direction, and in the present explanation the linear path 30*a* at the front is referred to as the front linear path 30*a*, and the linear path 30*b* at the rear is referred to as the rear linear path 30*b*. The curved path 30*c* that links together the lower ends of the front linear path 30*a* and the rear linear path 30*b* is referred to as the lower curved path 30*c*.

The conveyance path 30 is provided with plural conveyance rollers 40 respectively disposed facing one another across the conveyance path 30, conveyance guides 41 (see FIG. 3) provided running along the conveyance path 30, and conveyor belts 42 entrained around the conveyance rollers 40. Banknotes can be conveyed in either direction by rotating the conveyance rollers 40 in the desired direction using a motor, not illustrated in the drawings.

The plural classification sensors 31 (31*a* to 31*d*) are disposed on the front linear path 30*a* of the conveyance path 30. The plural classification sensors 31 (31*a* to 31*d*) classify a banknote as it passes through the front linear path 30*a*.

The pay-in/pay-out port section 21 described above is positioned above the front linear path 30*a*, and is capable of connecting with the upper end of the front linear path 30*a*. The temporary holding section 23 described above is positioned above the rear linear path 30*b*, and is capable of connecting with the upper end of the rear linear path 30*b*.

The reject box 24 described above is positioned in front of the front linear path 30*a*, and is capable of connecting with the upper end of the front linear path 30*a*. The retrieval box 25 described above is disposed in front of the lower curved path 30*c*, and is capable of connecting with a lower end of the lower curved path 30*c*.

The sorting conveyance path 27 described above is positioned to the rear of the upper end of the rear linear path 30*b*, and is capable of connecting with the upper end of the rear linear path 30*b*.

The conveyance path 30 is provided with the respective conveyance path switching units 32 (32*a*, 32*b* and 32*c*) at the three locations, these being the upper end of the front linear path 30*a*, the upper end of the rear linear path 30*b*, and the lower end of the lower curved path 30*c*, that configure the connection locations between the obtained money port section 21, the temporary holding section 23, the reject box 24, the retrieval box 25, and the sorting conveyance path 27.

Namely, the conveyance path switching unit 32*a* is provided at the upper end of the front linear path 30*a* that configures the connection location with the pay-in/pay-out port section 21 and the reject box 24. The conveyance path switching unit 32*b* is provided at the upper end of the rear linear path 30*b* that configures the connection location with the temporary holding section 23 and the sorting conveyance path 27. The conveyance path switching unit 32*c* is provided at the lower end of the lower curved path 30*c* that configures the connection location with the retrieval box 25.

The three conveyance path switching units 32 (32*a* to 32*c*) are controlled by the controller 10, and are capable of switching between connection, and non-connection, of the classification section 22 with the obtained money port section 21, the temporary holding section 23, the reject box 24, the retrieval box 25 and the sorting conveyance path 27. The conveyance destination of a banknote can accordingly be switched between the obtained money port section 21, the temporary holding section 23, the reject box 24, the retrieval box 25 and the sorting conveyance path 27.

The conveyance state detection sensor 33 is moreover disposed at a specific position below the conveyance path switching unit 32*b* provided to the upper end of the rear linear path 30*b*. The conveyance state detection sensor 33 detects the conveyance state of a banknote on the rear linear path 30*b*.

Note that the classification sensors 31 (31*a* to 31*d*) described above are disposed below the conveyance path switching unit 32*a* provided at the upper end of the front linear path 30*a*.

The classification section 22 is configured as described above.

The sorting conveyance path 27 is configured as a linear path extending in the front-rear direction from a rear end of the classification section 22 to an upper end of the rearmost banknote storage box 26*d*.

The sorting conveyance path 27 is provided with plural conveyance rollers 50 respectively disposed facing each other on both sides of the sorting conveyance path 27, conveyance guides 51 (see FIG. 3) provided running along the sorting conveyance path 27, and conveyor belts 52 entrained around the respective conveyance rollers 50. The sorting conveyance path 27 is capable of conveying banknotes in either direction by rotating the conveyance rollers 50 in the desired direction using a motor, not illustrated in the drawings.

A front end of the sorting conveyance path 27 is capable of connecting with the upper end of the rear linear path 30*b* of the classification section 22 and with an upper end of the foremost banknote storage box 26*a*. A rear end of the sorting conveyance path 27 is capable of connecting with the upper end of the rearmost banknote storage box 26*d*.

The sorting conveyance path 27 is also capable of connecting with upper ends of the remaining two banknote storage box 26*b*, 26*c* at two specific locations between the front end and the rear end of the sorting conveyance path 27.

The sorting conveyance path 27 is moreover provided with conveyance path switching units 53 (53*a* to 53*d*) respectively serving as examples of switching units at the connection locations with the classification section 22 and the four banknote storage boxes 26 (26*a* to 26*d*) at a total of four locations, these being the front end, rear end, and the two specific locations between the front end and the rear end, of the sorting conveyance path 27.

Namely, the conveyance path switching unit 53*a* is provided at the front end of the sorting conveyance path 27 that configures the connection location with the classification section 22 and the foremost banknote storage box 26*a*. To the rear thereof, the conveyance path switching unit 53*b* is provided at the connection location with the second banknote storage box 26*b*. To the rear thereof, the conveyance path switching unit 53*c* is provided at the connection location with the third banknote storage box 26*c*. Moreover, the conveyance path switching unit 53*d* is provided at the rear end of the sorting conveyance path sorting conveyance path 27 that configures the connection location with the rearmost fourth banknote storage box 26*d*.

Under control of the controller 10, the four conveyance path switching units 53 (53*a* to 53*d*) are capable of switching between connection and non-connection of the sorting conveyance path 27 with the classification section 22 and the four banknote storage boxes 26. The conveyance destination of a banknote can accordingly be switched to the classification section 22, or to one of the four banknote storage boxes 26.

Conveyance state detection sensors 54 (54*a*, 54*b*) are respectively disposed at the two locations of the front end and the rear end of the sorting conveyance path 27 (see FIG. 3). The conveyance state detection sensors 54 (54*a*, 54*b*) detect the conveyance state of a banknote on the sorting conveyance path 27.

The sorting conveyance path 27 is configured as described above.

Note that, although not illustrated in the drawings, each of the mechanism sections configuring the banknote pay-in/pay-out device 4 described above is installed with a drive motor, an electromagnetic solenoid and a mechanism position detection sensor. Moreover, the controller 10 drives the required drive motors and electromagnetic solenoids and detects the state of the mechanism sections with the mechanism position detection sensors according to the banknote transaction.

Although not illustrated in the drawings, each of the mechanism sections is installed with a banknote position detection sensor that detects the position of banknotes. The controller 10 uses the banknote position detection sensors installed to each mechanism section to monitor banknote position and movement according to the banknote transaction.

1-3. Pay-In Counting Processing of the Banknote Pay-In/Pay-Out Device

Next, explanation is given regarding pay-in counting processing operation of the banknote pay-in/pay-out device 4, with reference to FIG. 4 to FIG. 7. Note that this operation is principally performed under control of the controller 10 of the banknote pay-in/pay-out device 4.

The banknote pay-in/pay-out device 4 opens the pay-in/pay-out port shutter 5 when the user has inserted a cash card or the like into the ATM 1, and has input a transaction selection (pay-in, in this case) and a PIN number using the operation display section 6. The banknote pay-in/pay-out device 4 thereby adopts a state in which banknotes can be inserted.

Figure 4:
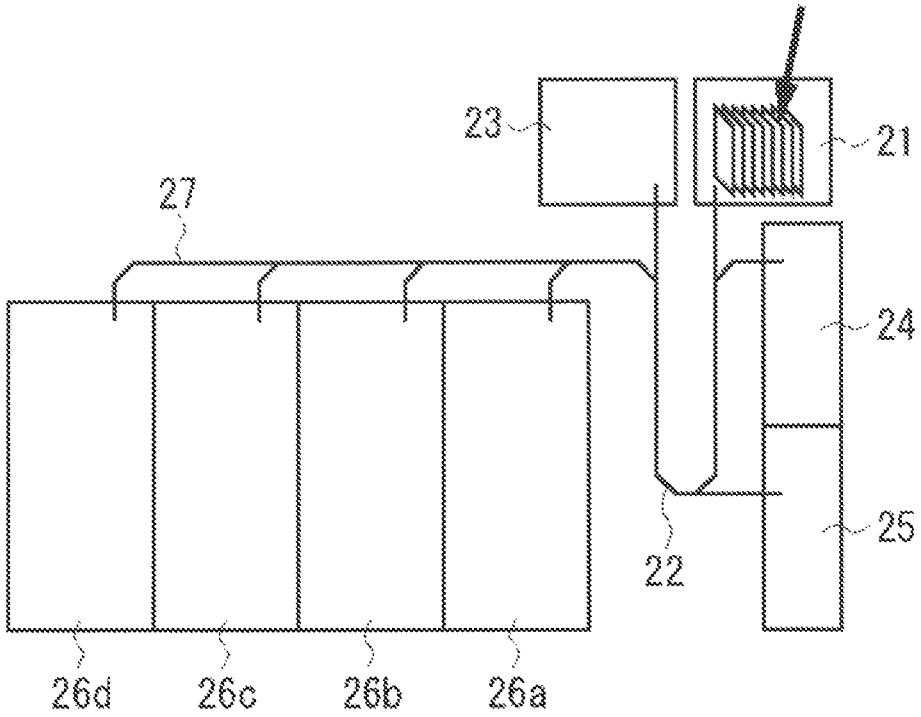
FIG. 4 is a schematic diagram to accompany explanation of pay-in counting processing (1) of the first exemplary embodiment.

Then, as illustrated in FIG. 4, when the user has inserted banknotes into the pay-in/pay-out port section 21, the banknote pay-in/pay-out device 4 detects banknote insertion using a sensor (not illustrated in the drawings) inside the pay-in/pay-out port section 21, and closes the pay-in/pay-out port shutter 5 (see FIG. 2).

Figure 5:
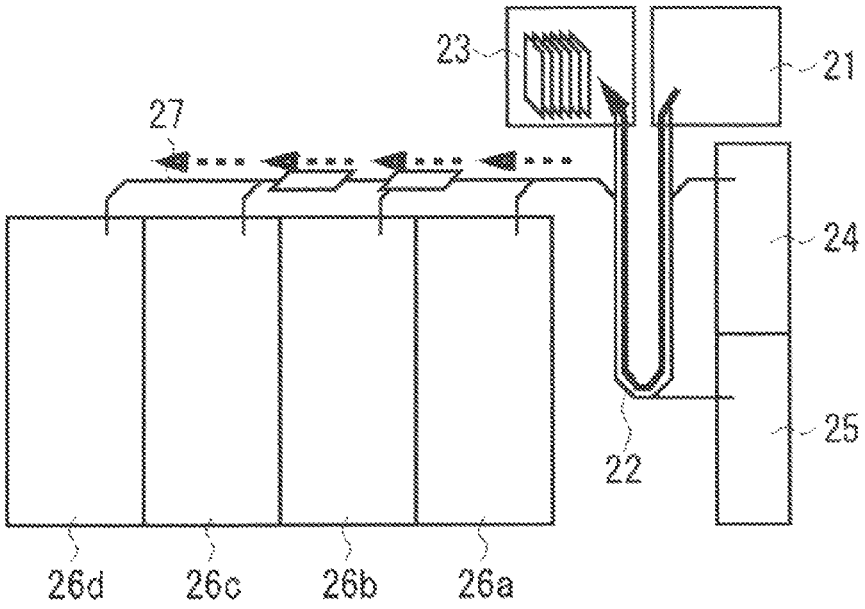
FIG. 5 is a schematic diagram to accompany explanation of pay-in counting processing (2) of the first exemplary embodiment.

Then, as illustrated in FIG. 5, the banknotes inserted into the pay-in/pay-out port section 21 are separated into individual notes, and are fed out to the downstream classification section 22.

The classification section 22 uses the internally mounted classification sensors 31 (see FIG. 2) to extract features of the banknotes one note at a time, and determines, for example, the authenticity, physical condition, denomination and conveyance state of the banknotes, one note at a time. The conveyance path switching unit 32*b* (see FIG. 2), disposed at the connection location between the temporary holding section 23 and the sorting conveyance path 27, is switched according to the determination results.

Namely, when the classification section 22 has determined a banknote to be a banknote that can be paid in (namely a normal banknote), the conveyance path switching unit 32*b* (see FIG. 2) is switched such that the conveyance destination of the banknote is the temporary holding section 23. The banknote is then conveyed from the classification section 22 to the temporary holding section 23 and is stacked inside the temporary holding section 23. When this is performed, the controller 10 counts the banknotes stacked inside the temporary holding section 23 according to the denomination of the banknotes as classified by the classification section 22.

However, when the classification section 22 has determined a banknote to be a banknote that cannot be paid in (namely a pay-in reject banknote), the conveyance path switching unit 32*b* (see FIG. 2) is switched such that the conveyance destination of the banknote is the sorting conveyance path 27. The banknote is then conveyed from the classification section 22 to the sorting conveyance path 27, and is temporarily retained in the sorting conveyance path 27.

Next, once counting of the banknotes in the pay-in/pay-out port section 21 has been completed, the banknote pay-in/pay-out device 4 returns the banknote (namely the pay-in reject banknote) that has been temporarily retained in the sorting conveyance path 27 to the user.

However, once the number of pay-in reject banknotes temporarily retained in the sorting conveyance path 27 reaches a specific number (namely the maximum number of notes than can be temporarily retained in the sorting conveyance path 27), the banknote pay-in/pay-out device 4 interrupts pay-in counting processing and returns, to the user, the banknotes (namely the pay-in reject banknotes) temporarily retained in the sorting conveyance path 27.

Figure 6:
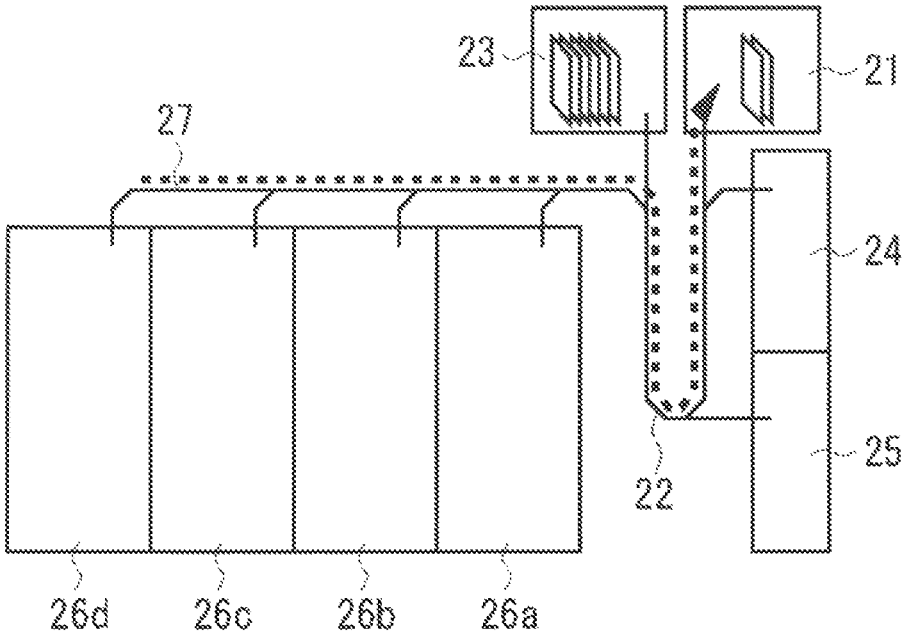
FIG. 6 is a schematic diagram to accompany explanation of pay-in counting processing (3) of the first exemplary embodiment.

When pay-in reject banknotes are returned, as illustrated in FIG. 6, the pay-in reject banknotes that have been temporarily retained in the sorting conveyance path 27 are fed out to the classification section 22, one note at a time. The pay-in reject banknotes are then replaced in the pay-in/pay-out port section 21 through the classification section 22 and stacked inside the pay-in/pay-out port section 21.

The ATM 1 displays pay-in reject banknote removal guidance on the operation display section 6. When this is performed, the banknote pay-in/pay-out device 4 opens the pay-in/pay-out port shutter 5 to adopt a state in which the pay-in reject banknotes can be removed.

Figure 7:
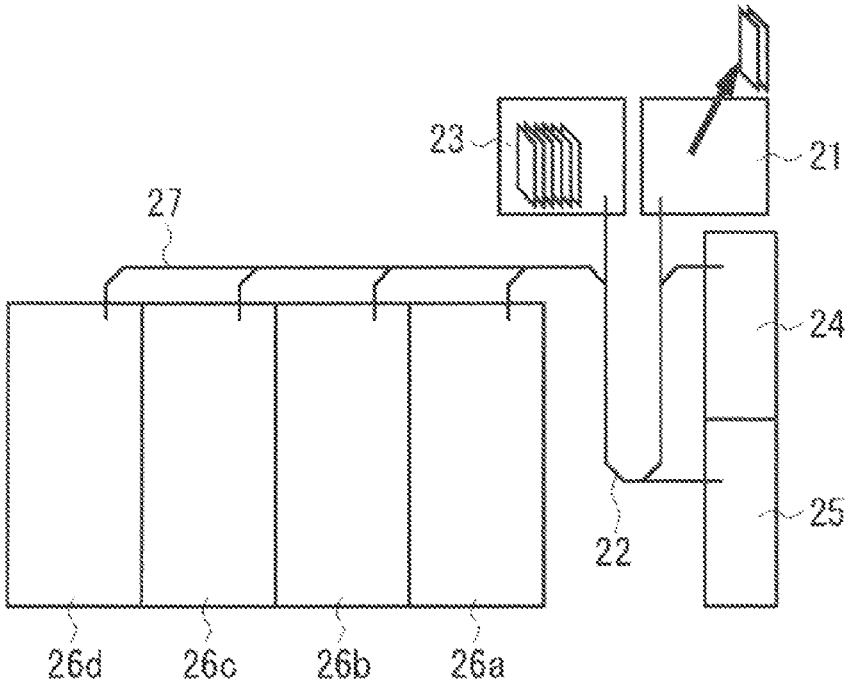
FIG. 7 is a schematic diagram to accompany explanation of pay-in counting processing (4) of the first exemplary embodiment.

Then, as illustrated in FIG. 7, when the user takes the banknotes out from the pay-in/pay-out port section 21, a sensor (not illustrated in the drawings) inside the pay-in/pay-out port section 21 detects removal of the banknotes, and the pay-in/pay-out port shutter 5 closes. The pay-in/pay-out port shutter 5 is then reopened to a state allowing banknote insertion.

When the user once again inserts banknotes into the pay-in/pay-out port section 21, the sensor (not illustrated in the drawings) inside the pay-in/pay-out port section 21 detects banknote insertion, and the pay-in/pay-out port shutter 5 closes. The inserted banknotes are once again counted using the process described above.

Pay-in counting processing is performed by the banknote pay-in/pay-out device 4 by the process described above.

On completion of pay-in counting processing, the ATM 1 displays a pay-in counting result on the operation display section 6 to confirm the pay-in counting result with the user.

When the user uses the operation display section 6 to input an instruction approving the pay-in transaction, the banknote pay-in/pay-out device 4 performs banknote storage processing, described later.

1-4. Pay-In Reject Banknote Retrieval Processing by the Banknote Pay-In/Pay-Out Device Next, explanation is given regarding pay-in reject banknote retrieval processing operation of the banknote pay-in/pay-out device 4, with reference to FIG. 8 and FIG. 9. Note that this operation is also principally performed under control of the controller 10 of the banknote pay-in/pay-out device 4.

The pay-in reject banknote retrieval processing is processing performed when the user leaves behind pay-in reject banknotes that were replaced in the pay-in/pay-out port section 21 during the pay-in counting processing described above.

Specifically, when the pay-in reject banknotes are not taken out from the pay-in/pay-out port section 21 within a certain duration after replacing the pay-in reject banknotes in the pay-in/pay-out port section 21 during the pay-in counting processing described above, the banknote pay-in/pay-out device 4 first closes the pay-in/pay-out port shutter 5.

Figure 8:
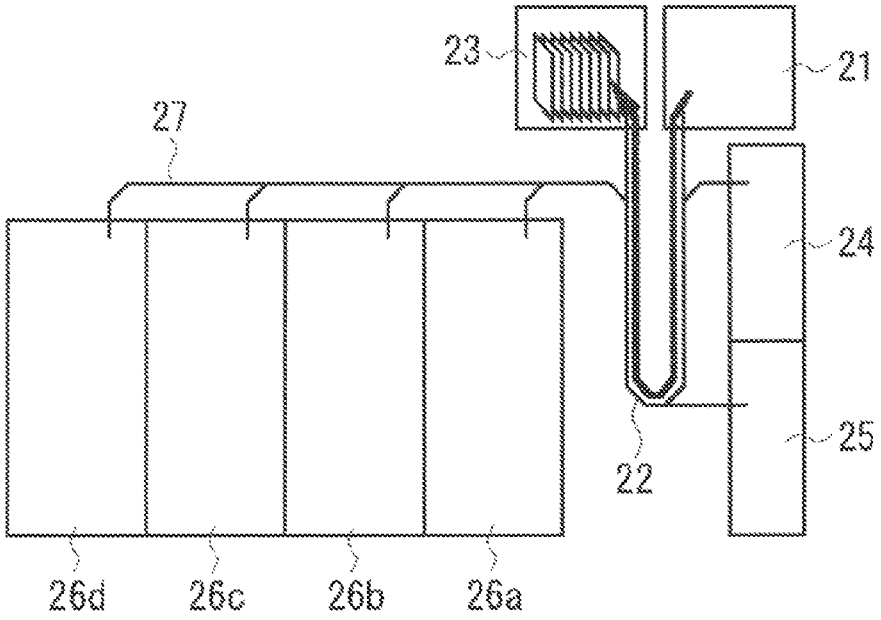
FIG. 8 is a schematic diagram to accompany explanation of pay-in reject banknote retrieval processing (1).

Then, as illustrated in FIG. 8, the pay-in reject banknotes stacked in the pay-in/pay-out port section 21 are separated into individual notes and conveyed along the downstream classification section 22 to the temporary holding section 23, and stacked together with any banknotes that are already stacked in the temporary holding section 23.

Figure 9:
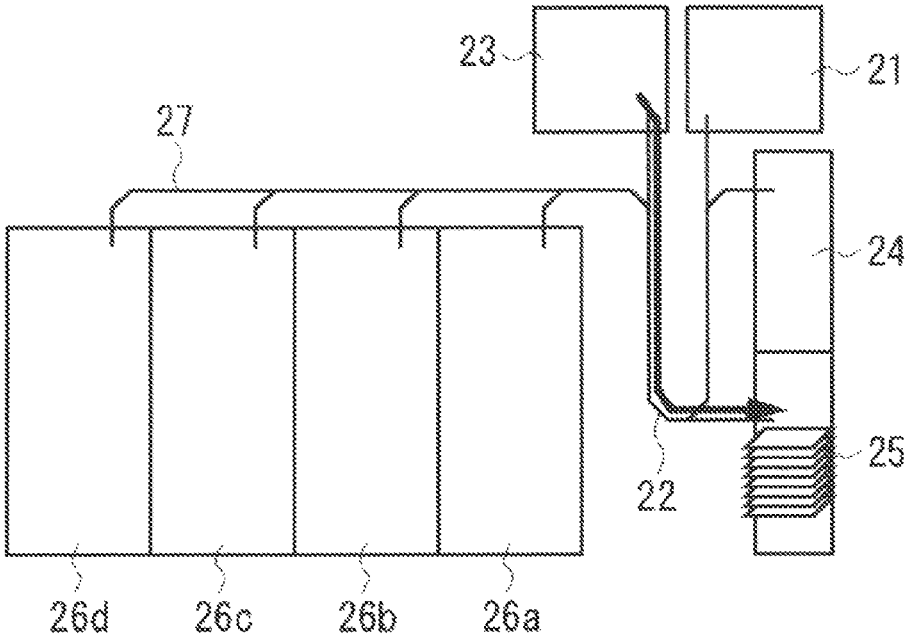
FIG. 9 is a schematic diagram to accompany explanation of pay-in reject banknote retrieval processing (2).

Then, as illustrated in FIG. 9, the banknotes stacked in the temporary holding section 23 are fed into the classification section 22 one note at a time, conveyed from the classification section 22 to the retrieval box 25, and stacked in the retrieval box 25.

The banknote pay-in/pay-out device performs pay-in reject banknote retrieval processing by the above process.

1-5. Banknote Storage Processing of the Banknote Pay-In/Pay-Out Device

Figure 10:
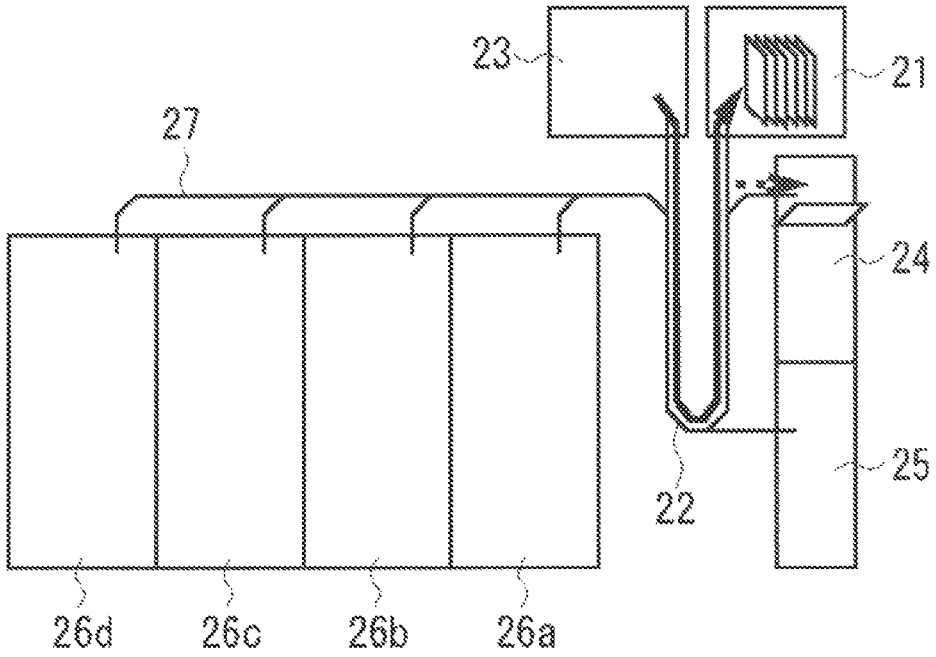
FIG. 10 is a schematic diagram to accompany explanation of banknote storage processing (1) of the first exemplary embodiment.
Figure 11:
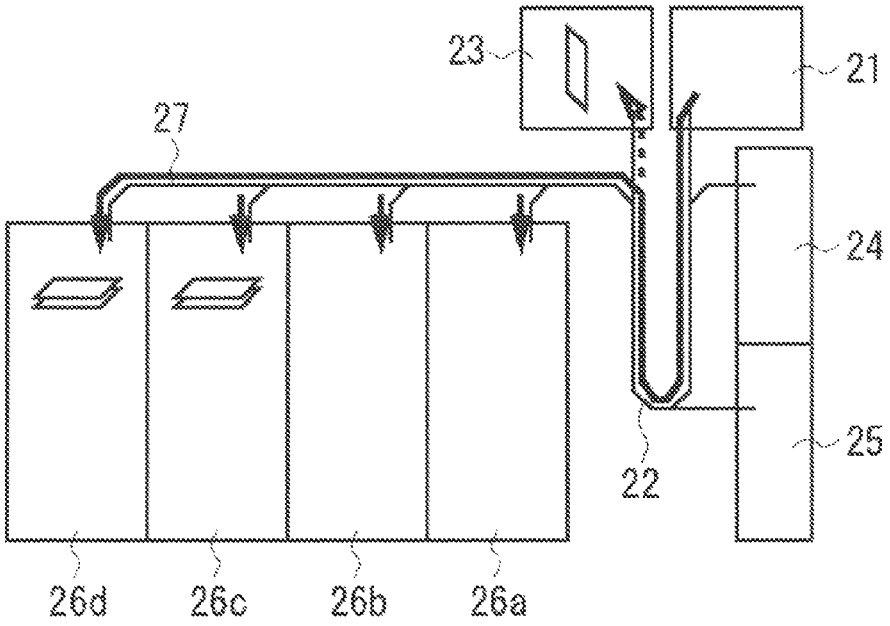
FIG. 11 is a schematic diagram to accompany explanation of banknote storage processing (2) of the first exemplary embodiment.
Figure 12:
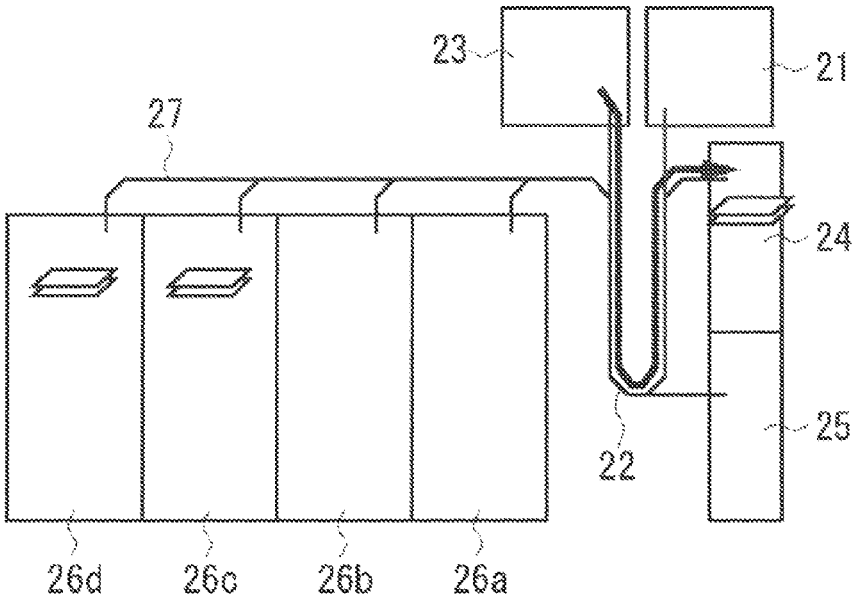
FIG. 12 is a schematic diagram to accompany explanation of banknote storage processing (3) of the first exemplary embodiment.

Next, explanation is given regarding banknote storage processing of the banknote pay-in/pay-out device 4, with reference to FIG. 10 to FIG. 12. Note that this operation is also principally performed under control of the controller 10 of the banknote pay-in/pay-out device 4.

The banknote storage processing is processing performed after the user has input an instruction to approve a pay-in transaction.

Specifically, as illustrated in FIG. 10, the banknotes stacked in the temporary holding section 23 during the pay-in counting processing described above are separated into individual notes and fed out to the classification section 22.

The classification section 22 uses the internally mounted classification sensors 31 (see FIG. 2) to extract features of the banknotes one note at a time, and determines, for example, the physical condition, denomination and conveyance state of the banknotes, one note at a time. The conveyance path switching unit 32*a* (see FIG. 2), disposed at the connection location between the pay-in/pay-out port section 21 and the reject box 24, is switched according to the determination results.

Namely, when the classification section 22 has determined a banknote to be a banknote unsuitable for storage (namely a storage reject banknote), the conveyance path switching unit 32*a* is switched such that the conveyance destination of the banknote is the reject box 24. The banknote is then conveyed from the classification section 22 to the reject box 24 and stacked in the reject box 24.

However, when the classification section 22 has determined a banknote to be a storable banknote (namely a normal banknote), the conveyance path switching unit 32*a* is switched such that the conveyance destination of the banknote is the pay-in/pay-out port section 21. The banknote is then conveyed from the classification section 22 to the pay-in/pay-out port section 21 and stacked in the pay-in/pay-out port section 21.

Then, as illustrated in FIG. 11, the banknotes stacked in the pay-in/pay-out port section 21 are separated into individual notes, and once again fed out into the downstream classification section 22.

In the classification section 22, the classification sensors 31 once again extract features of the banknotes one note at a time, and classify the denomination and conveyance state of the banknotes, one note at a time. The conveyance path switching unit 32*b* (see FIG. 2), disposed at the connection location between the temporary holding section 23 and the sorting conveyance path 27, is switched according to the determination results.

Namely, when a banknote has been determined by the classification section 22 to be a storable banknote (normal banknote), the conveyance path switching unit 32*b* is switched such that the conveyance destination of the banknote is the sorting conveyance path 27. The banknote is then conveyed from the classification section 22 to the sorting conveyance path 27.

The conveyance path switching units 53 (53*a* to 53*d*) on the sorting conveyance path 27 are switched according to the denomination of the banknote conveyed from the classification section 22.

Namely, the conveyance path switching units 53 (53*a* to 53*d*) are switched such that the banknote conveyance destination is the banknote storage box 26 (26*a* to 26*d*) corresponding to the banknote denomination. The banknote is then conveyed from the sorting conveyance path 27 to the banknote storage box 26 of the corresponding denomination, and stacked in the banknote storage box 26 (26*a* to 26*d*) of the corresponding denomination.

However, when a banknote is determined by the classification section 22 to be a banknote that is unsuitable for storage (storage reject banknote), the conveyance path switching unit 32*b* (see FIG. 2) is switched such that the banknote conveyance destination is the temporary holding section 23. The banknote is then conveyed from the classification section 22 to the temporary holding section 23 and stacked in the temporary holding section 23.

Then, once classification has been completed for all of the banknotes in the pay-in/pay-out port section 21, the banknotes stacked in the temporary holding section 23 (namely the storage reject banknotes) are fed out to the classification section 22 one note at a time, pass through the classification section 22 and are stacked in the reject box 24, as illustrated in FIG. 12.

The banknote pay-in/pay-out device 4 performs banknote storage processing by the above process.

Note that when one of the banknote storage boxes 26 (26*a* to 26*d*) is set as a reject box, the notes determined by the classification section 22 to be banknotes that are unsuitable for storage (storage reject banknotes) are stacked in the banknote storage box 26 set as the reject box instead of in the reject box 24.

The pay-in counting processing, pay-in reject banknote retrieval processing and banknote storage processing described thus far are processing relating to pay-in of banknotes. Explanation follows regarding processing relating to the pay-out of banknotes.

1-6. Pay-Out Transaction Processing of the Banknote Pay-In/Pay-Out Device

Figure 13:
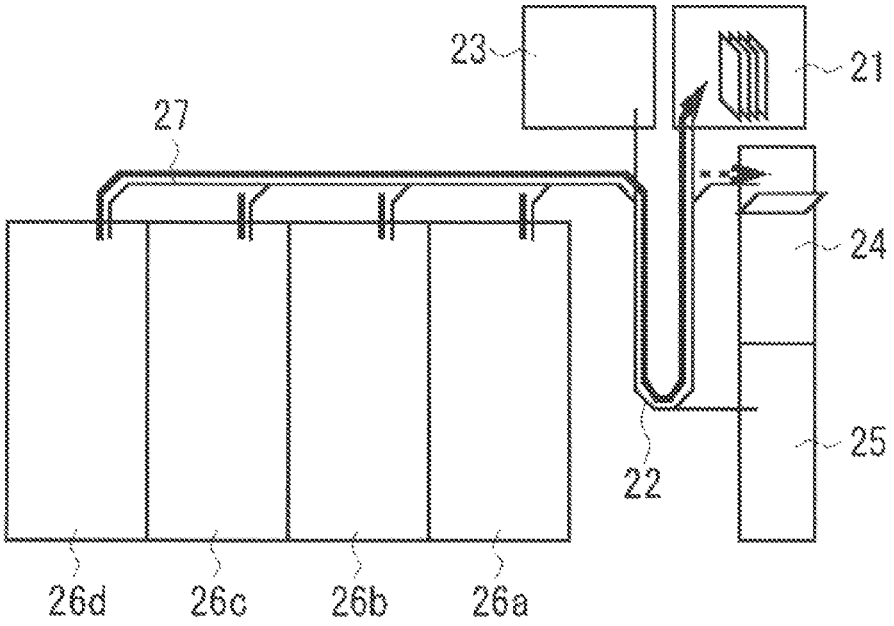
FIG. 13 is a schematic diagram to accompany explanation of pay-out transaction processing.

Next, explanation is given regarding pay-out transaction processing operation of the banknote pay-in/pay-out device 4, with reference to FIG. 13. Note that this operation is also principally performed under control of the controller 10 of the banknote pay-in/pay-out device 4.

When the user has inserted a cash card or the like into the ATM 1, and has input information such as a transaction selection (pay-out, in this case), a PIN number, and a pay-out amount using the operation display section 6, the banknote pay-in/pay-out device 4 identifies the required number of notes of each denomination according to the requested amount. The banknote pay-in/pay-out device 4 then feeds banknotes from the banknote storage boxes 26 (26*a* to 26*d*) to the sorting conveyance path 27 and conveys the banknotes to the classification section 22, one note at a time, according to the number of notes of each denomination.

In the classification section 22, the internally mounted classification sensors 31 (see FIG. 2) determine, for example, the banknote conveyance state, one note at a time. The conveyance path switching unit 32*a* (see FIG. 2), disposed at the connection location with the pay-in/pay-out port section 21 and the reject box 24, is switched according to the determination results.

Namely, when the classification section 22 has determined a banknote to be a banknote that cannot be paid out (namely a pay-out reject banknote), the conveyance path switching unit 32*a* is switched such that the banknote conveyance destination is the reject box 24. The banknote is then conveyed from the classification section 22 to the reject box 24 and stacked in the reject box 24.

However, when the classification section 22 has determined a banknote to be a banknote that can be paid out (namely a normal banknote), the conveyance path switching unit 32*a* is switched such that the banknote conveyance destination is the pay-in/pay-out port section 21. The banknote is then conveyed from the classification section 22 to the pay-in/pay-out port section 21 and stacked in the pay-in/pay-out port section 21.

Once conveyance of the banknotes corresponding to the pay-out amount has been completed, the banknote pay-in/pay-out device 4 opens the pay-in/pay-out port shutter 5. The banknotes stacked in the pay-in/pay-out port section 21 are thereby placed in a removable state.

Then, when the user has taken the banknotes out of the pay-in/pay-out port section 21, the sensors (not illustrated in the drawings) inside the pay-in/pay-out port section 21 detect the removal of the banknotes and the pay-in/pay-out port shutter 5 is closed.

The banknote pay-in/pay-out device 4 performs pay-out transaction processing by the above process.

1-7. Pay-Out Banknote Retrieval Processing of the Banknote Pay-In/Pay-Out Device Next, explanation is given regarding pay-out banknote retrieval processing operation performed by the banknote pay-in/pay-out device 4, with reference to FIG. 14 and FIG. 15. Note that this operation is also principally performed under control of the controller 10 of the banknote pay-in/pay-out device 4.

The pay-out banknote retrieval processing is processing that is performed when the user leaves behind banknotes that were stacked in the pay-in/pay-out port section 21 during the pay-out transaction processing described above.

Specifically, when banknotes have not been taken out from the pay-in/pay-out port section 21 within a certain duration after stacking the banknotes in the pay-in/pay-out port section 21, the banknote pay-in/pay-out device 4 first closes the pay-in/pay-out port shutter 5.

Figure 14:
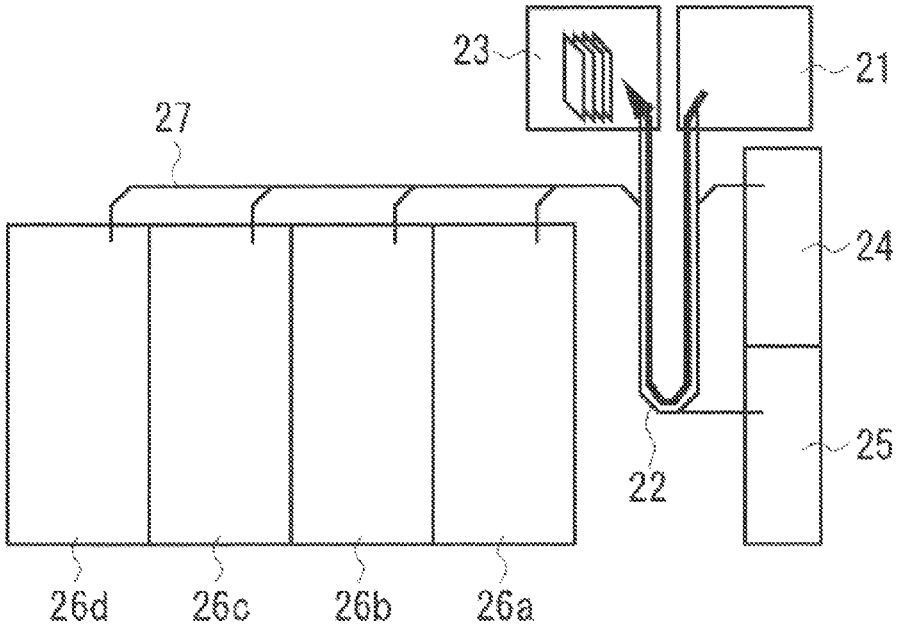
FIG. 14 is a schematic diagram to accompany explanation of pay-out banknote retrieval processing (1).

Then, as illustrated in FIG. 14, the notes stacked in the pay-in/pay-out port section 21 (namely forgotten banknotes) are separated into individual notes and fed out to the downstream classification section 22.

The classification section 22 uses the internally mounted classification sensors 31 (see FIG. 2) to determine, for example, the conveyance state of the banknotes, one note at a time. The conveyance path switching unit 32*b* of the classification section 22 is switched such that the banknote conveyance destination is the temporary holding section 23, regardless of the determination results.

The banknotes are then conveyed from the classification section 22 to the temporary holding section 23 and stacked in the temporary holding section 23.

Figure 15:
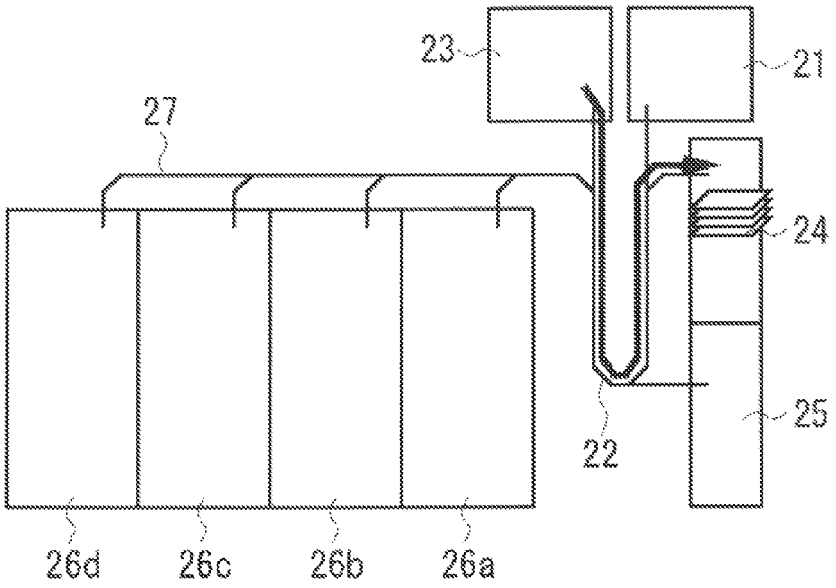
FIG. 15 is a schematic diagram to accompany explanation of pay-out banknote retrieval processing (2).

Then, as illustrated in FIG. 15, the banknotes stacked in the temporary holding section 23 (namely the forgotten banknotes) are then fed out into the classification section 22, one note at a time, pass through the classification section 22 and are stacked in the reject box 24.

The banknote pay-in/pay-out device 4 performs pay-out banknote retrieval processing by the above process.

Note that when one of the banknote storage boxes 26 (26*a* to 26*d*) is set as a reject box, the forgotten banknotes are stacked in the banknote storage box 26 set as the reject box instead of in the reject box 24.

Moreover, in the banknote pay-in/pay-out device 4 setting may be made in advance such that banknotes among the forgotten banknotes that can be reused for paying out are stored in the banknote storage boxes 26 (26*a* to 26*d*).

Specifically, when setting is made to reuse forgotten banknotes, the banknotes (namely the forgotten banknotes) stacked in the pay-in/pay-out port section 21 are separated into individual notes and fed out to the downstream classification section 22.

The classification section 22 uses the internally mounted classification sensors 31 to extract features of the banknotes one note at a time, and determines, for example, the authenticity, physical condition, denomination and conveyance state of the banknotes. The conveyance path switching unit 32*b*, disposed at the connection location with the temporary holding section 23 and the sorting conveyance path 27, is switched according to the determination results.

Namely, when the classification section 22 has determined a banknote to be a storable banknote (namely a normal banknote), the conveyance path switching unit 32*b* is switched such that the banknote conveyance destination is the sorting conveyance path 27. The banknote is then conveyed from the classification section 22 to the sorting conveyance path 27.

The conveyance path switching units 53 (53*a* to 53*d*) on the sorting conveyance path 27 are switched according to the denomination of the banknote conveyed from the classification section 22. The banknote is then stacked in the banknote storage box 26 (26*a* to 26*d*) of the corresponding denomination.

However, when a banknote is determined by the classification section 22 to be a banknote that is unsuitable for storage, the conveyance path switching unit 32*b* is switched such that the banknote conveyance destination is the temporary holding section 23. The banknote is then conveyed from the classification section 22 to the temporary holding section 23 and stacked in the temporary holding section 23.

Then, once classification has been completed for all of the banknotes in the pay-in/pay-out port section 21, the banknotes stacked in the temporary holding section 23 (namely banknotes among the forgotten banknotes that cannot be reused) are fed out to the classification section 22 one note at a time, pass through the classification section 22 and are stacked in the reject box 24.

Note that when one of the banknote storage boxes 26 (26*a* to 26*d*) is set as a reject box, the notes determined by the classification section 22 to be banknotes that are unsuitable for storage are stacked in the banknote storage box 26 set as the reject box instead of in the reject box 24.

The pay-out transaction processing, and the pay-out banknote retrieval processing described thus far are processing relating to the pay-out of banknotes.

1-8. Temporary Retention of Pay-In Reject Banknotes

More detailed explanation follows regarding operation during the temporary retention of pay-in reject banknotes on the sorting conveyance path 27 in the banknote pay-in counting processing described above, with reference to FIG. 16 to FIG. 20. Note that this operation is also principally performed under control of the controller 10 of the banknote pay-in/pay-out device 4.

Out of the banknotes inserted into the pay-in/pay-out port section 21, the first banknote determined by the classification sensors 31 disposed on the front linear path 30*a* of the classification section 22 to be a banknote that cannot be paid in is denoted pay-in reject banknote BL1. The pay-in reject banknote BL1 passes from the front linear path 30*a* of the classification section 22, through the lower curved path 30*c* and advances upwards in the rear linear path 30*b*.

Figure 16:
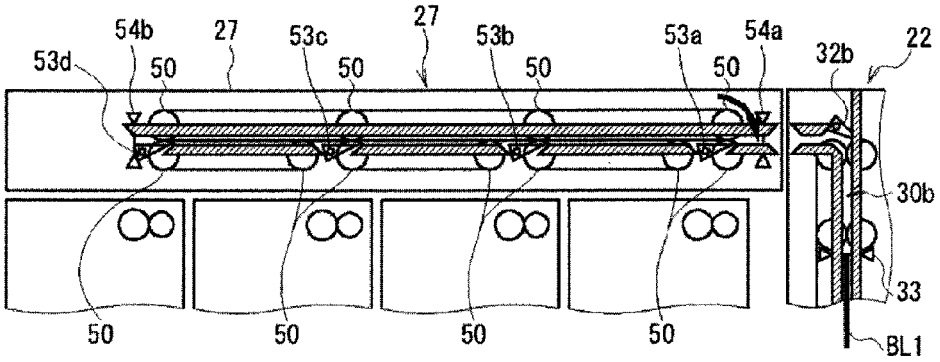
FIG. 16 is a schematic diagram to accompany explanation of temporary retention of pay-in reject banknotes (1) of the first exemplary embodiment.

Then, as illustrated in FIG. 16, the conveyance state detection sensor 33 disposed on the rear linear path 30*b* detects when a leading edge of the first pay-in reject banknote BL1 has reached the conveyance state detection sensor 33.

Note that in this explanation, out of the two conveyance direction ends of a banknote, the end positioned foremost in the conveyance direction is referred to as the leading edge, and the end positioned rearmost in the conveyance direction is referred to as the trailing edge.

Thereupon, the banknote pay-in/pay-out device 4 switches the conveyance path switching unit 32*b* that is disposed ahead (namely upwards) of the conveyance state detection sensor 33 such that the conveyance destination of the first pay-in reject banknote BL1 is the sorting conveyance path 27.

When this is performed, the banknote pay-in/pay-out device 4 also actuates a motor, not illustrated in the drawings, to rotate the conveyance rollers 50 of the sorting conveyance path 27 such that the conveyance direction of the sorting conveyance path 27 is a direction heading from the front end of the sorting conveyance path 27 toward the rear end of the sorting conveyance path 27.

Note that when this is performed, the conveyance path switching units 53 (53*a* to 53*d*) that are disposed along the sorting conveyance path 27 have already been respectively switched such that the sorting conveyance path 27 is not connected to the banknote storage boxes 26 (26*a* to 26*d*).

In other words, the conveyance path switching units 53 (53*a* to 53*d*) are switched such that the banknote will advance toward the rear of the sorting conveyance path 27 without entering any of the banknote storage boxes 26.

The pay-in reject banknote BL1 that has passed the conveyance state detection sensor 33 of the rear linear path 30*b* is then conveyed from the classification section 22 to the sorting conveyance path 27, and advances along the sorting conveyance path 27 toward the rear.

Figure 17:
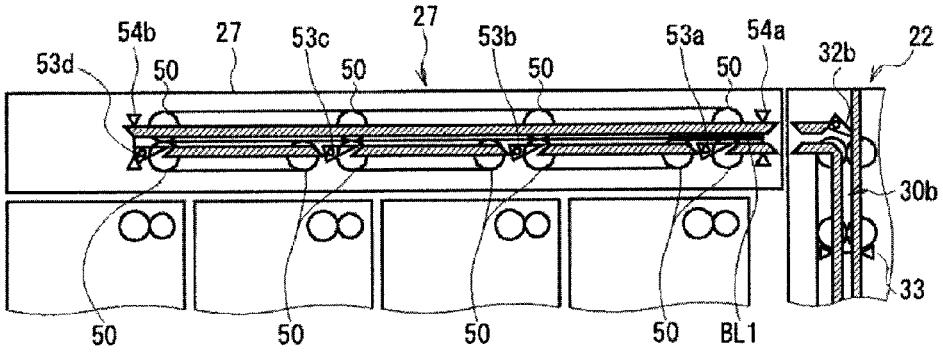
FIG. 17 is a schematic diagram to accompany explanation of temporary retention of pay-in reject banknotes (2) of the first exemplary embodiment.

Then, as illustrated in FIG. 17, the conveyance state detection sensor 54*a* disposed at the front end of the sorting conveyance path 27 detects when the trailing edge of the first pay-in reject banknote BL1 has reached the conveyance state detection sensor 54*a*.

Thereupon, the banknote pay-in/pay-out device 4 stops the motor, not illustrated in the drawings, stopping rotation of the conveyance rollers 50 of the sorting conveyance path 27. When this is performed, the pay-in reject banknote stops at the front end of the sorting conveyance path 27. The first pay-in reject banknote BL1 is thereby temporarily retained in the sorting conveyance path 27.

Figure 18:
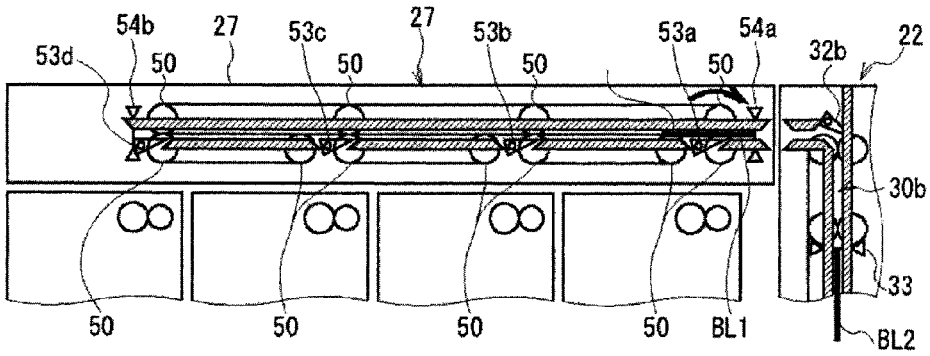
FIG. 18 is a schematic diagram to accompany explanation of temporary retention of pay-in reject banknotes (3) of the first exemplary embodiment.

Then, as illustrated in FIG. 18, the banknote pay-in/pay-out device 4 uses the conveyance state detection sensor 33 disposed on the rear linear path 30*b* to detect when the leading edge of a second pay-in reject banknote BL2 has reached the conveyance state detection sensor 33. The banknote pay-in/pay-out device 4 then switches the conveyance path switching unit 32*b* that is disposed ahead of (namely above) the conveyance state detection sensor 33 such that the conveyance destination of the second pay-in reject banknote BL2 is the sorting conveyance path 27.

When this is performed, the banknote pay-in/pay-out device 4 once again also actuates the motor, not illustrated in the drawings, rotating the conveyance rollers 50 of the sorting conveyance path 27 such that the conveyance direction of the sorting conveyance path 27 is the direction heading from the front end of the sorting conveyance path 27 toward the rear end of the sorting conveyance path 27.

The first pay-in reject banknote BL1 that is temporarily retained in the sorting conveyance path 27 accordingly advances toward the rear.

In other words, the first pay-in reject banknote BL1 is made to advance toward the rear before the second pay-in reject banknote BL2 enters the sorting conveyance path 27. The second pay-in reject banknote BL2 to be conveyed up therefore does not overlap with the first pay-in reject banknote BL1 on the sorting conveyance path 27.

The second pay-in reject banknote BL2 that has passed the conveyance state detection sensor 33 of the rear linear path 30*b* is then conveyed from the classification section 22 to the sorting conveyance path 27, and advances toward the rear of the sorting conveyance path 27.

Note that the first pay-in reject banknote BL1 is already advancing toward the rear before the second pay-in reject banknote BL2 enters the sorting conveyance path 27. The first pay-in reject banknote BL1 and the second pay-in reject banknote BL2 accordingly advance toward the rear in a state with a uniform interval therebetween.

Figure 19:
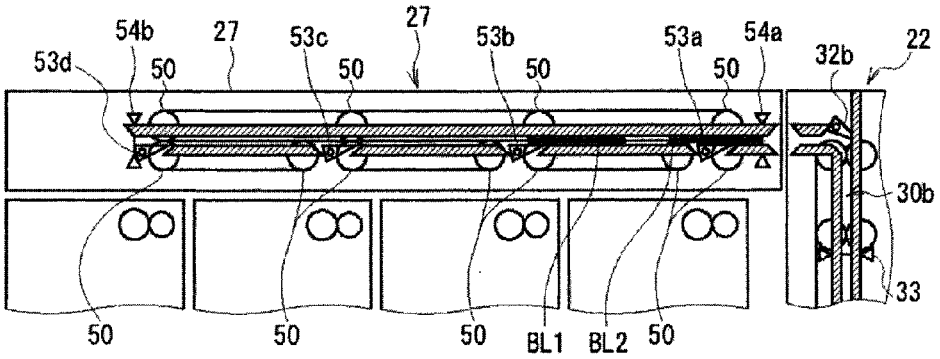
FIG. 19 is a schematic diagram to accompany explanation of temporary retention of pay-in reject banknotes (4) of the first exemplary embodiment.

Then, as illustrated in FIG. 19, the banknote pay-in/pay-out device 4 uses the conveyance state detection sensor 54*a* that is disposed at the front end of the sorting conveyance path 27 to detect when the trailing edge of the second pay-in reject banknote BL2 reaches the conveyance state detection sensor 54*a*. The banknote pay-in/pay-out device 4 then stops the motor, not illustrated in the drawings, stopping rotation of the conveyance rollers 50 of the sorting conveyance path 27. When this is performed, the second pay-in reject banknote BL2 stops at the front end of the sorting conveyance path 27.

When this is performed, the first pay-in reject banknote BL1 stops at a uniform separation ahead of the second pay-in reject banknote BL2.

The first and second pay-in reject banknotes BL1 and BL2 are thus temporarily retained in the sorting conveyance path 27.

Subsequently, out of the banknotes inserted by the user, the banknote pay-in/pay-out device 4 temporarily retains any banknotes determined to be pay-in reject banknotes in the sorting conveyance path 27, as described above.

Pay-in reject banknotes are thus temporarily retained in the sorting conveyance path 27. Then, as illustrated in FIG. 20, at a point in time when the leading edge of the first pay-in reject banknote BL1 has reached the conveyance state detection sensor 54*b* disposed at the rear end of the sorting conveyance path 27, the number of pay-in reject banknotes that are temporarily retained in the sorting conveyance path 27 reaches the maximum temporarily retainable number of banknotes on the sorting conveyance path 27.

Figure 20:
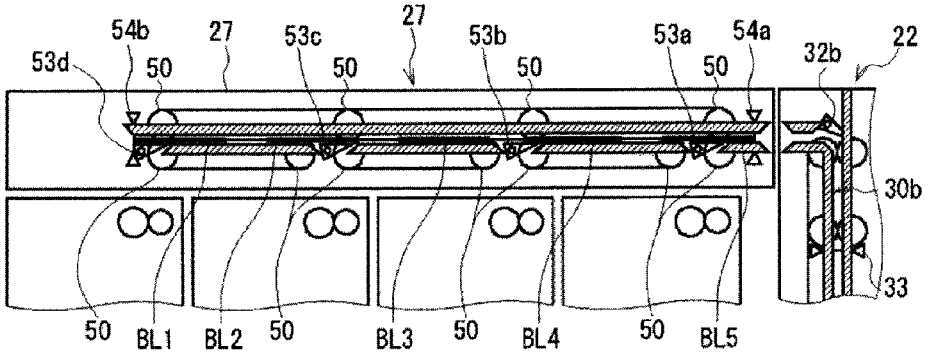
FIG. 20 is a schematic diagram to accompany explanation of temporary retention of pay-in reject banknotes (5) of the first exemplary embodiment.

Note that, as an example, FIG. 20 illustrates a state in which five pay-in reject banknotes BL1 to BL5, this being the maximum number, are temporarily retained in the sorting conveyance path 27.

When the number of pay-in reject banknotes temporarily retained in the sorting conveyance path 27 thus reaches the maximum temporarily retainable number, or when pay-in counting processing of the banknotes inserted into the pay-in/pay-out port section 21 is completed before reaching the maximum temporarily retainable number, the banknote pay-in/pay-out device 4 returns the pay-in reject banknotes that are temporarily retained in the sorting conveyance path 27 to the user, as explained with reference to FIG. 6.

1-9. Operation and Advantageous Effects

In the configuration described above, in the banknote pay-in/pay-out device 4, the classification section 22, configured by the conveyance path 30 that links together the pay-in/pay-out port section 21 and the temporary holding section 23, is disposed between the pay-in/pay-out port section 21 and the temporary holding section 23, and the classification sensors 31 are provided along the conveyance path 30.

During pay-in counting processing, the banknote pay-in/pay-out device 4 conveys banknotes inserted into the pay-in/pay-out port section 21 to the downstream classification section 22, and the classification sensors 31 of the classification section 22 classify the banknotes. Moreover, the banknote pay-in/pay-out device 4 conveys banknotes determined by the classification result to be normal banknotes to the downstream temporary holding section 23 and stacks the banknotes in the temporary holding section 23.

In the banknote pay-in/pay-out device 4, the sorting conveyance path 27 is moreover linked to the vicinity of the connection location of the conveyance path 30 of the classification section 22 to the temporary holding section 23, downstream of the classification sensors 31. In the banknote pay-in/pay-out device 4, the conveyance path switching units 32 that switch the banknote conveyance destination to the temporary holding section 23 or to the sorting conveyance path 27 are disposed at this position.

During pay-in counting processing, when a banknote is determined to be a pay-in reject banknote as a result of banknote classification by the classification sensors 31 of the classification section 22, the banknote pay-in/pay-out device 4 switches the banknote conveyance destination from the temporary holding section 23 to the sorting conveyance path 27. The banknote pay-in/pay-out device 4 then conveys the banknote to the sorting conveyance path 27 and retains the banknote on the sorting conveyance path 27.

So doing enables the ATM 1 to, for example, temporarily retain pay-in reject banknotes during pay-in counting processing until the pay-in counting processing is completed, and then replace the pay-in reject banknotes in the pay-in/pay-out port section 21 to be returned to the user after completion of the pay-in counting processing, without providing a partitioning plate to the pay-in/pay-out port section 21 as hitherto.

In the first exemplary embodiment, the sorting conveyance path 27 that functions as a conveyance path between the classification section 22 and the plural banknote storage boxes 26 (26*a* to 26*d*) during banknote storage processing and pay-out transaction processing is utilized as the temporary retention destination of pay-in reject banknotes during pay-in counting processing.

Namely, the sorting conveyance path 27, hitherto unused in pay-in counting processing, is utilized as the temporary retention destination of pay-in reject banknotes during pay-in counting processing in the first exemplary embodiment.

So doing eliminates the need to provide the ATM 1 with a separate temporary storage box that only handles pay-in reject banknotes, enabling an increase in cost due to temporarily retaining pay-in reject banknotes to be suppressed to a minimum, as well as enabling an increase in size of the banknote pay-in/pay-out device 4 to be avoided.

Note that many examples of the banknote pay-in/pay-out device 4 include plural (for example four or more) banknote storage boxes 26 (26*a* to 26*d*) corresponding to each banknote denomination, such that the sorting conveyance path 27 linking the banknote storage boxes 26 is of sufficient length to retain a fixed number of pay-in reject banknotes, or greater.

Accordingly, in many examples of the banknote pay-in/pay-out device 4, the sorting conveyance path 27 can be utilized as the temporary retention destination for pay-in reject banknotes as it is, for example without being extended.

Moreover, in the first exemplary embodiment, the classification section 22 is configured by the conveyance path 30 that links together the pay-in/pay-out port section 21 and the temporary holding section 23, and by the classification sensors 31 disposed along the conveyance path 30. Moreover, in the present exemplary embodiment, the conveyance path switching unit 32*b*, that switches the banknote conveyance destination to the temporary holding section 23 or to the sorting conveyance path 27, is provided at a position downstream of the classification sensors 31 of the classification section 22 during pay-in counting processing on the conveyance path 30.

So doing enables the banknote pay-in/pay-out device 4 to continually process inserted banknotes while the banknotes inserted into the pay-in/pay-out port section 21 are being sorted into normal banknotes that are conveyed to the temporary holding section 23, or pay-in reject banknotes that are conveyed to the sorting conveyance path 27.

According to the configuration described above, pay-in reject banknotes can be replaced in the pay-in/pay-out port section and returned to the user without providing a partitioning plate to the pay-in/pay-out port section 21 as hitherto. Namely, pay-in reject banknotes are conveyed to the sorting conveyance path 27 during pay-in counting processing, and are, for example, temporarily retained until pay-in counting processing has been completed. Then, after pay-in counting processing has been completed, the pay-in reject banknotes can be replaced in the pay-in/pay-out port section 21 and returned to the user. A simpler pay-in/pay-out port section mechanism can accordingly be achieved than hitherto.

2. Second Exemplary Embodiment

Explanation follows regarding a second exemplary embodiment. The second exemplary embodiment is an exemplary embodiment in which one of the banknote storage boxes 26 is configured as a temporary retention destination for pay-in reject banknotes, instead of the sorting conveyance path.

Note that, other than regarding the point that the pay-in reject banknote temporary retention destination has been changed, reference should be made to the first exemplary embodiment regarding configuration and so on of the banknote pay-in/pay-out device 4, since this is similar to that in the first exemplary embodiment. Accordingly, explanation given herein principally relates to pay-in counting processing.

2-1. Pay-In Counting Processing of the Banknote Pay-In/Pay-Out Device 4

Explanation follows regarding pay-in counting processing operation of the banknote pay-in/pay-out device 4 of the second exemplary embodiment. Note that this operation is also principally performed under control of the controller 10 of the banknote pay-in/pay-out device 4.

In the second exemplary embodiment, one (for example the rearmost banknote storage box 26*d*) out of the banknote storage boxes 26 (26*a* to 26*d*) of the banknote pay-in/pay-out device 4 is set in advance as the pay-in reject banknote temporary retention destination. The remaining banknote storage boxes 26 (26*a* to 26*c*) are set as banknote storage boxes for each respective denomination.

When the user has inserted a cash card or the like into the ATM 1, and has input information such as a transaction selection (pay-in, in this case) and a PIN number, using the operation display section 6, the banknote pay-in/pay-out device 4 set as described above opens the pay-in/pay-out port shutter 5. The banknote pay-in/pay-out device 4 thereby adopts a state in which banknotes can be inserted.

Then, when the user has inserted banknotes into the pay-in/pay-out port section 21, the banknote pay-in/pay-out device 4 detects banknote insertion using the sensor (not illustrated in the drawings) inside the pay-in/pay-out port section 21, and closes the pay-in/pay-out port shutter 5.

Figure 21:
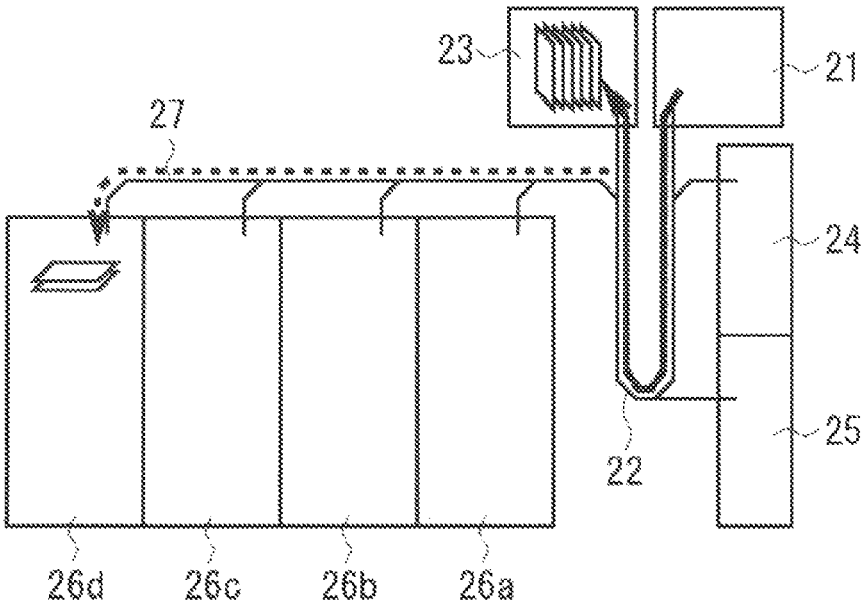
FIG. 21 is a schematic diagram to accompany explanation of pay-in counting processing (1) of a second exemplary embodiment.

Then, as illustrated in FIG. 21, the banknotes inserted into the pay-in/pay-out port section 21 are separated into individual notes, and are fed out to the downstream classification section 22.

The classification section 22 uses the internally mounted classification sensors 31 (see FIG. 2) to extract features of the banknotes one note at a time, and determines, for example, the authenticity, physical condition, denomination and conveyance state of the banknotes, one note at a time. In the banknote pay-in/pay-out device 4, the conveyance path switching unit 32*b* (see FIG. 2), disposed at the connection location between the temporary holding section 23 and the sorting conveyance path 27, is switched according to the determination results.

Namely, when the classification section 22 has determined a banknote to be a banknote that can be paid in (namely a normal banknote), the conveyance path switching unit 32*b* is switched such that the conveyance destination of the banknote is the temporary holding section 23. The banknote is then conveyed from the classification section 22 to the temporary holding section 23 and is stacked inside the temporary holding section 23. When this is performed, the controller 10 counts the banknotes stacked inside the temporary holding section 23 according to the denomination of the banknotes as classified by the classification section 22.

However, when the classification section 22 has determined a banknote to be a banknote that cannot be paid in (namely a pay-in reject banknote), the conveyance path switching unit 32*b* is switched such that the conveyance destination of the banknote is the sorting conveyance path 27. The banknote is then conveyed from the classification section 22 to the sorting conveyance path 27.

On the sorting conveyance path 27, the rearmost banknote storage box 26*d* (see FIG. 3) is set as the pay-in reject banknote temporary retention destination. The conveyance path switching units 53 (53*a* to 53*d*) on the sorting conveyance path 27 are switched such that the conveyance destination of the pay-in reject banknote conveyed up from the classification section 22 is the banknote storage box 26*d* (see FIG. 3).

The pay-in reject banknote is then conveyed from the sorting conveyance path 27 to the banknote storage box 26*d* and temporarily retained inside the banknote storage box 26*d*.

Then, once counting of the banknotes in the pay-in/pay-out port section 21 has been completed, the banknote pay-in/pay-out device 4 returns the banknote (namely the pay-in reject banknote) that has been temporarily retained in the banknote storage box 26*d* to the user.

However, once the number of temporarily retained pay-in reject banknotes reaches a specific number (namely the maximum number of notes than can be temporarily retained), the banknote pay-in/pay-out device 4 interrupts pay-in counting processing. The banknote pay-in/pay-out device 4 then returns the banknotes (namely the pay-in reject banknotes) temporarily retained in the banknote storage box 26*d* to the user.

Figure 22:
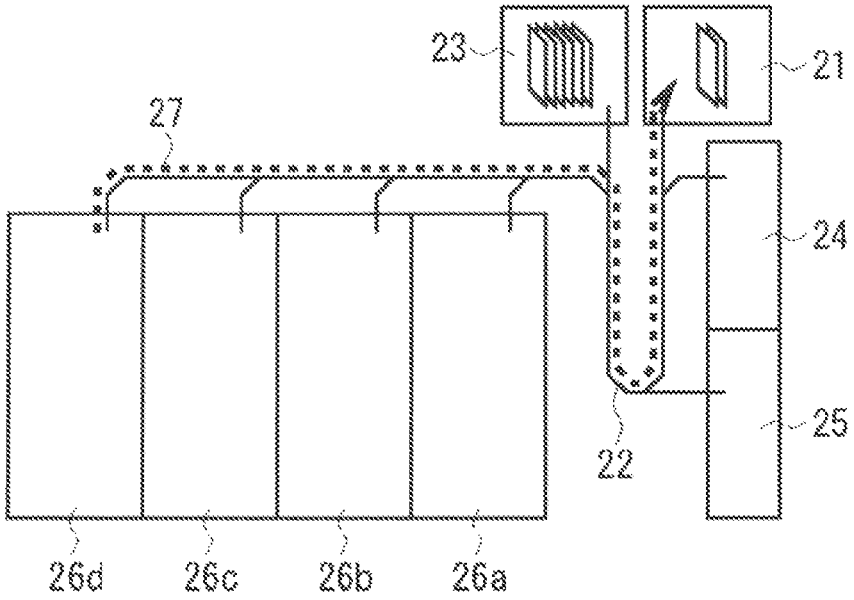
FIG. 22 is a schematic diagram to accompany explanation of pay-in counting processing (2) of the second exemplary embodiment.

When the pay-in reject banknotes are returned, the pay-in reject banknotes that have been temporarily retained in the banknote storage box 26*d* are fed out to the sorting conveyance path 27, one note at a time, as illustrated in FIG. 22. The pay-in reject banknotes are then replaced in the pay-in/pay-out port section 21 from the sorting conveyance path 27 through the classification section 22, and are stacked inside the pay-in/pay-out port section 21.

The ATM 1 then displays pay-in reject banknote removal guidance on the operation display section 6. When this is performed, the banknote pay-in/pay-out device 4 opens the pay-in/pay-out port shutter 5 to adopt a state in which the pay-in reject banknotes can be removed.

Then, when the user takes the banknotes out from the pay-in/pay-out port section 21, the sensor (not illustrated in the drawings) inside the pay-in/pay-out port section 21 detects the removal of the banknotes, and the pay-in/pay-out port shutter 5 closes. The pay-in/pay-out port shutter 5 is then reopened to adopt a state allowing banknote insertion.

When the user once again inserts banknotes into the pay-in/pay-out port section 21, the sensor (not illustrated in the drawings) inside the pay-in/pay-out port section 21 detects banknote insertion, and the pay-in/pay-out port shutter 5 closes. The inserted banknotes are once again counted by the process described above.

Pay-in counting processing is performed by the banknote pay-in/pay-out device 4 by the process described above.

2-2. Operation and Advantageous Effects

In the configuration described above, in the second exemplary embodiment one out of the banknote storage boxes 26 (26*a* to 26*d*) of the banknote pay-in/pay-out device 4 is set in advance as the pay-in reject banknote temporary retention destination.

During pay-in counting processing, the banknote pay-in/pay-out device 4 classifies a banknote using the classification sensors 31 of the classification section 22. As a result, when a banknote has been determined to be a pay-in reject banknote, the banknote pay-in/pay-out device 4 conveys the banknote through the sorting conveyance path 27 to the banknote storage box 26*d*, and the banknote is temporarily retained in the banknote storage box 26*d*.

So doing enables the banknote pay-in/pay-out device 4 to replace the pay-in reject banknote in the pay-in/pay-out port section 21 to be returned to the user without providing a partitioning plate to the pay-in/pay-out port section 21 as hitherto. Namely, during pay-in counting processing, the banknote pay-in/pay-out device 4 conveys a pay-in reject banknote to the banknote storage box 26*d* to be temporarily retained until, for example, pay-in counting processing has been completed. After pay-in counting processing has been completed, the banknote pay-in/pay-out device 4 is then able to replace the pay-in reject banknote in the pay-in/pay-out port section 21 to be returned to the user.

Moreover, in the second exemplary embodiment, one of the banknote storage boxes 26 (26*a* to 26*d*) is utilized as the pay-in reject banknote temporary retention destination. There is accordingly no need to provide the banknote pay-in/pay-out device 4 with a separate dedicated temporary storage box for pay-in reject banknotes, enabling an increase in cost due to temporarily retaining pay-in reject banknotes to be suppressed to a minimum. The second exemplary embodiment moreover enables an increase in size of the banknote pay-in/pay-out device 4 to be avoided.

3. Third Exemplary Embodiment

Explanation follows regarding a third exemplary embodiment. In the third exemplary embodiment, one of the banknote storage boxes 26 (26*a* to 26*d*) is made to function as a temporary holding section, and the temporary holding section 23 instead configures the pay-in reject banknote temporary retention destination.

Note that, regarding configuration and the like of the banknote pay-in/pay-out device 4, reference should be made to the first exemplary embodiment, since configuration is similar to that of the first exemplary embodiment, the first exemplary embodiment may be used for reference. Accordingly, explanation given herein principally relates to pay-in counting processing.

3-1. Pay-In Counting Processing of the Banknote Pay-In/Pay-Out Device 4

Explanation follows regarding pay-in counting processing operation of the banknote pay-in/pay-out device 4 of the third exemplary embodiment. Note that this operation is also principally performed under control of the controller 10 of the banknote pay-in/pay-out device 4.

In the third exemplary embodiment, one (for example the rearmost banknote storage box 26*d*) out of the banknote storage boxes 26 (26*a* to 26*d*) of the banknote pay-in/pay-out device 4 is set in advance as the temporary holding section in place of the temporary holding section 23. The remaining banknote storage boxes 26 (26*a* to 26*c*) are set as banknote storage boxes for each denomination. The original temporary holding section 23 is moreover set in advance as the pay-in reject banknote temporary retention destination.

When the user has inserted a cash card or the like into the ATM 1, and has input information such as a transaction selection (pay-in, in this case) and a PIN number, using the operation display section 6, the banknote pay-in/pay-out device 4 set as described above opens the pay-in/pay-out port shutter 5. The banknote pay-in/pay-out device 4 is thereby placed in state in which banknotes can be inserted.

Then, when the user has inserted banknotes into the pay-in/pay-out port section 21, the banknote pay-in/pay-out device 4 detects banknote insertion using the sensor (not illustrated in the drawings) inside the pay-in/pay-out port section 21, and closes the pay-in/pay-out port shutter 5.

Figure 23:
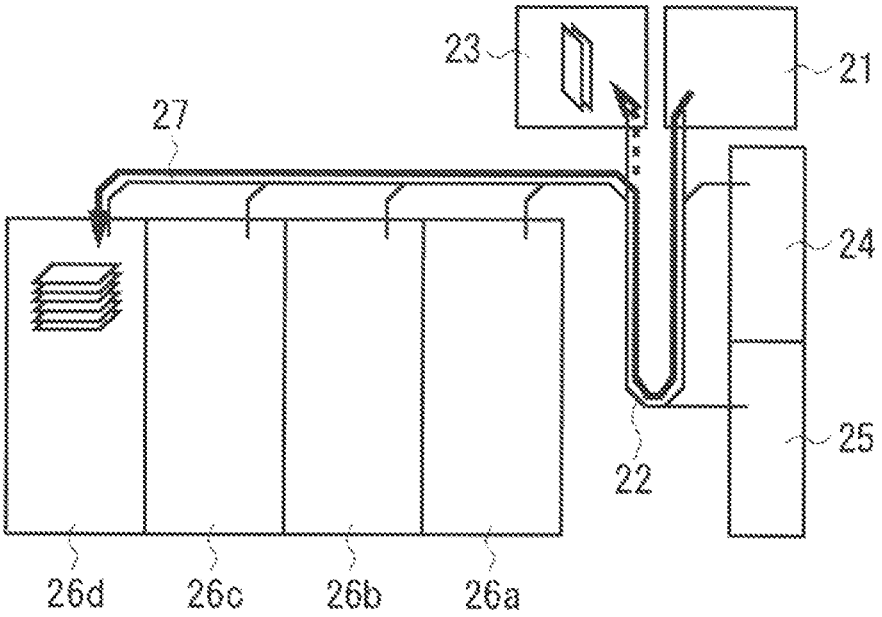
FIG. 23 is a schematic diagram to accompany explanation of pay-in counting processing (1) of a third exemplary embodiment.

Then, as illustrated in FIG. 23, the banknotes inserted into the pay-in/pay-out port section 21 are separated into individual notes, and are fed out to the downstream classification section 22.

The classification section 22 uses the internally mounted classification sensors 31 (see FIG. 2) to extract features of the banknotes one note at a time, and determines, for example, the authenticity, physical condition, denomination and conveyance state of the banknotes, one note at a time. In the banknote pay-in/pay-out device 4, the conveyance path switching unit 32*b* (see FIG. 2), disposed at the connection location between the temporary holding section 23 and the sorting conveyance path 27, is switched according to the determination results.

Namely, when the classification section 22 has determined a banknote to be a banknote that can be paid in (namely a normal banknote), the conveyance path switching unit 32*b* is switched such that the conveyance destination of the banknote is the sorting conveyance path 27. The banknote is then conveyed from the classification section classification section 22 to the sorting conveyance path 27.

The conveyance path switching units 53 (53*a* to 53*d*) on the sorting conveyance path 27 are switched such that the conveyance destination of the normal banknote conveyed up from the classification section 22 is the rearmost banknote storage box 26*d* set as the temporary holding section.

The normal banknote is then conveyed from the sorting conveyance path 27 to the banknote storage box 26*d* and temporarily held inside the banknote storage box 26*d*. When this is performed, the controller 10 counts the banknotes stacked inside the banknote storage box 26*d* that is set as the temporary holding section according to the denomination of the banknotes as classified by the classification section 22.

However, when the classification section 22 has determined a banknote to be a banknote that cannot be paid in (namely a pay-in reject banknote), the conveyance path switching unit 32*b* is switched such that the conveyance destination of the banknote is the temporary holding section 23. The pay-in reject banknote is then conveyed from the classification section 22 to the temporary holding section 23 and temporarily retained in the temporary holding section 23.

Then, once counting of the banknotes in the pay-in/pay-out port section 21 has been completed, the banknote pay-in/pay-out device 4 returns the banknote (namely the pay-in reject banknote) that has been temporarily retained in the temporary holding section 23 to the user.

However, once the number of temporarily retained pay-in reject banknotes reaches a specific number (namely the maximum number of notes than can be temporarily retained), the banknote pay-in/pay-out device 4 interrupts pay-in counting processing. The banknote pay-in/pay-out device 4 then returns the banknotes (namely the pay-in reject banknotes) temporarily retained in the temporary holding section 23 to the user.

Figure 24:
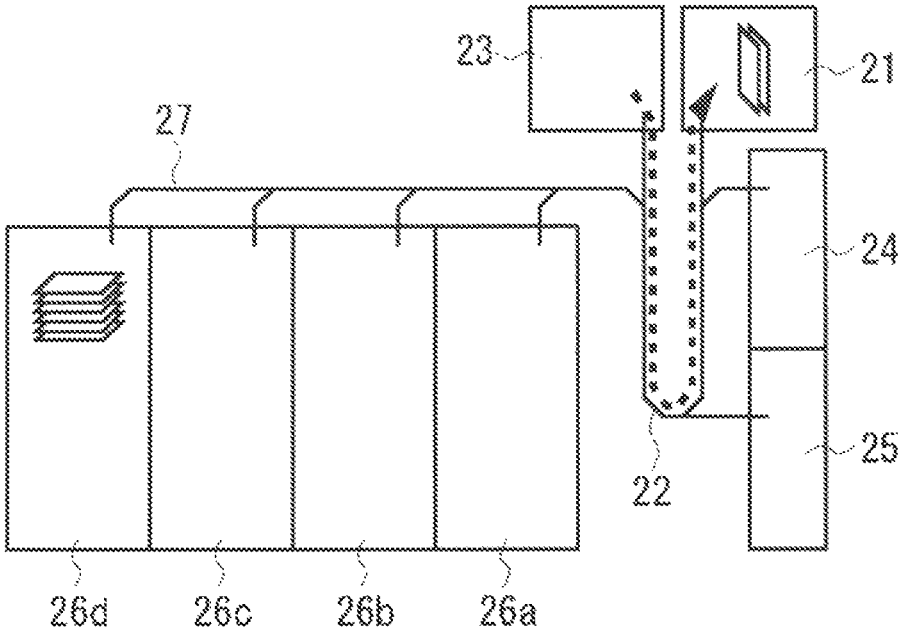
FIG. 24 is a schematic diagram to accompany explanation of pay-in counting processing (2) of the third exemplary embodiment.

When pay-in reject banknotes are returned, as illustrated in FIG. 24, the pay-in reject banknotes that have been temporarily retained in the temporary holding section 23 are fed out to the classification section 22, one note at a time. The pay-in reject banknotes are then replaced in the pay-in/pay-out port section 21 through the classification section 22 and stacked inside the pay-in/pay-out port section 21.

The ATM 1 displays pay-in reject banknote removal guidance on the operation display section 6. When this is performed, the banknote pay-in/pay-out device 4 opens the pay-in/pay-out port shutter 5 to adopt a state in which the pay-in reject banknotes can be removed.

Then, when the user takes the banknotes out from the pay-in/pay-out port section 21, the sensor (not illustrated in the drawings) inside the pay-in/pay-out port section 21 detects the removal of the banknotes, and the pay-in/pay-out port shutter 5 closes. The pay-in/pay-out port shutter 5 is then reopened to adopt a state allowing banknote insertion.

When the user once again inserts banknotes into the pay-in/pay-out port section 21, the sensor (not illustrated in the drawings) inside the pay-in/pay-out port section 21 detects banknote insertion, and the pay-in/pay-out port shutter 5 closes. The inserted banknotes are once again counted by the process described above.

Pay-in counting processing is performed by the banknote pay-in/pay-out device 4 by the process described above.

3-2. Banknote Storage Processing of the Banknote Pay-In/Pay-Out Device

Next, brief explanation is given regarding banknote storage processing operation of the banknote pay-in/pay-out device 4 of the third exemplary embodiment. Note that this operation is also principally performed under control of the controller 10 of the banknote pay-in/pay-out device 4.

The banknote storage processing is processing performed after the user has input instruction to approve a pay-in transaction.

Figure 25:
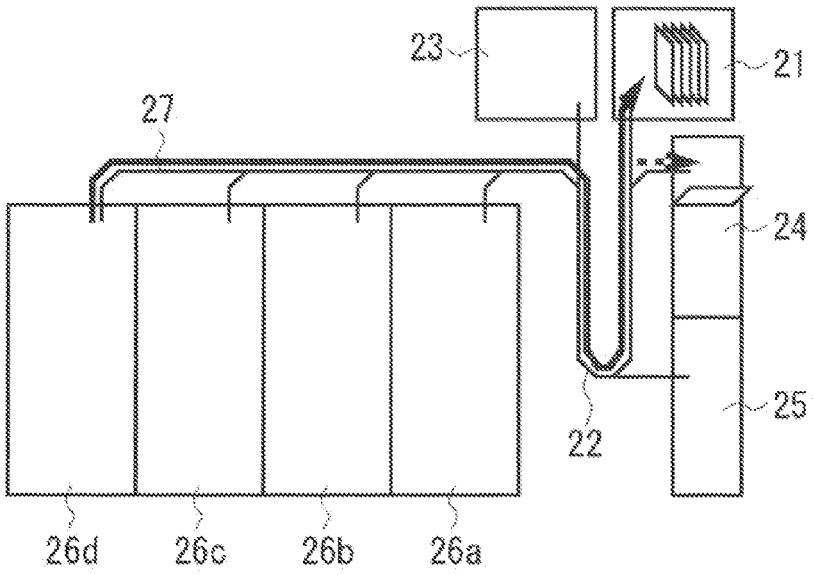
FIG. 25 is a schematic diagram to accompany explanation of banknote storage processing of the third exemplary embodiment.

Specifically, as illustrated in FIG. 25, the banknotes stacked in banknote storage box 26*d* during the pay-in counting processing described above are separated into individual notes and fed out to the classification section 22.

The classification section 22 uses the internally mounted classification sensors 31 (see FIG. 2) to extract features of the banknotes one note at a time, and determines, for example, the physical condition, denomination and conveyance state of the banknotes, one note at a time. In the banknote pay-in/pay-out device 4, the conveyance path switching unit 32*a* (see FIG. 2), disposed at the connection location between the pay-in/pay-out port section 21 and the reject box 24, is switched according to the determination results.

Namely, when the classification section 22 has determined a banknote to be a banknote unsuitable for storage (namely a storage reject banknote), the conveyance path switching unit 32*a* is switched such that the conveyance destination of the banknote is the reject box 24. The banknote is then conveyed from the classification section 22 to the reject box 24 and stacked in the reject box 24.

However, when the classification section 22 has determined a banknote to be a banknote to be a storable banknote (namely a normal banknote), the conveyance path switching unit 32*a* is switched such that the conveyance destination of the banknote is the pay-in/pay-out port section 21. The banknote is then conveyed from the classification section 22 to the pay-in/pay-out port section 21 and stacked in the pay-in/pay-out port section 21.

Subsequently, similarly to in the first exemplary embodiment, the banknotes are stored by denomination in the banknote storage boxes 26 (26*a* to 26*c*) by the process illustrated in FIG. 11.

Banknote storage processing is performed by the banknote pay-in/pay-out device 4 by the process described above.

3-3. Operation and Advantageous Effects

In the configuration described above, in the third exemplary embodiment one of the banknote storage boxes 26 (26*a* to 26*d*) is set in advance as the temporary holding section, and the original temporary holding section 23 is set in advance as the pay-in reject banknote temporary retention destination.

During pay-in counting processing, the banknote pay-in/pay-out device 4 classifies the banknotes using the classification sensors 31 of the classification section 22. When as a result the banknote pay-in/pay-out device 4 has determined a banknote to be a pay-in reject banknote, the banknote is retained in the temporary holding section 23.

So doing enables the banknote pay-in/pay-out device 4 to replace pay-in reject banknotes in the pay-in/pay-out port section 21 to be returned to the user without providing the pay-in/pay-out port section 21 with a partitioning plate as hitherto. Namely, during pay-in counting processing, the banknote pay-in/pay-out device 4 conveys pay-in reject banknotes to the temporary holding section 23 to be temporarily retained, for example, until pay-in counting processing has been completed. Then, once pay-in counting processing has been completed, the banknote pay-in/pay-out device 4 is able to replace the pay-in reject banknotes in the pay-in/pay-out port section 21 to be returned to the user.

Moreover, in the third exemplary embodiment, one of the banknote storage boxes 26 (26*a* to 26*d*) is made to function as the temporary holding section, in place of which the temporary holding section 23 is utilized as the pay-in reject banknote temporary retention destination. The banknote pay-in/pay-out device 4 is accordingly able to suppress an increase in cost due to temporarily retaining pay-in reject banknotes to be suppressed to a minimum, since there is no need to provide a separate dedicated pay-in reject banknote temporary storage box. An increase in size of the banknote pay-in/pay-out device 4 can moreover be avoided in the banknote pay-in/pay-out device 4.

4. Fourth Exemplary Embodiment

Explanation follows regarding a fourth exemplary embodiment. The fourth exemplary embodiment is an exemplary embodiment in which the configuration of the classification section and the sorting conveyance path differ from the first exemplary embodiment.

Note that since configuration other than that of the classification section and the sorting conveyance path is similar to that of the first exemplary embodiment, the first exemplary embodiment may be used for reference. Accordingly, explanation given herein principally relates to configuration of the classification section and the sorting conveyance path.

4-1. Classification Section and Sorting Conveyance Path Configuration

Figure 26:
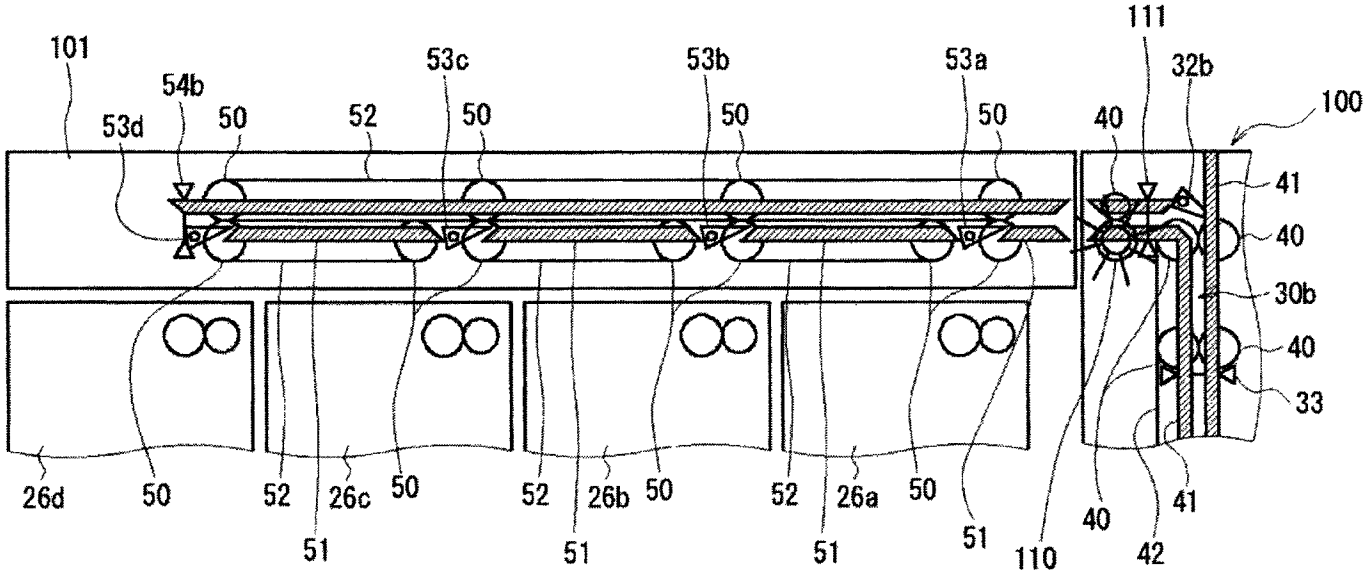
FIG. 26 is a schematic diagram illustrating a configuration of a classification section and a sorting conveyance path of a fourth exemplary embodiment.

Explanation follows regarding a classification section 100 and a sorting conveyance path 101 of the banknote pay-in/pay-out device 4 of the fourth exemplary embodiment, with reference to FIG. 26.

Note that explanation is principally given regarding configuration portions of the classification section 100 and the sorting conveyance path 101 that differ from those of the classification section 22 and the sorting conveyance path 27 of the first exemplary embodiment. Explanation regarding similar portions is omitted as appropriate.

The classification section 100 of the fourth exemplary embodiment is provided with a vaned wheel 110 that taps one end of a conveyed banknote. The vaned wheel 110 is disposed further to the rear than the conveyance path switching unit 32*b* that is disposed at the upper end of the rear linear path 30*b*, and is disposed immediately in front of the connection location with the sorting conveyance path 101. An additional conveyance roller 40 is disposed above the vaned wheel 110 so as to face the vaned wheel 110.

In the classification section 100, a conveyance state detection sensor 111 that detects the conveyance state of a banknote is further disposed between the vaned wheel 110 and the conveyance path switching unit 32*b*.

The addition of the vaned wheel 110, the conveyance roller 40 facing the vaned wheel 110, and the conveyance state detection sensor 111 configures a portion that differs from the classification section 22 of the first exemplary embodiment.

The sorting conveyance path 101 is configured without the conveyance state detection sensor 54*a* that is disposed at the front end of the sorting conveyance path 27 of the first exemplary embodiment.

The omission of the conveyance state detection sensor 54*a* thereby configures a portion that differs from the sorting conveyance path 27 of the first exemplary embodiment.

4-2. Pay-In Reject Banknote Temporary Retention

Next, detailed explanation is given regarding operation during temporary retention of pay-in reject banknotes in the sorting conveyance path 101 by the classification section 100 and the sorting conveyance path 101 configured as described above, with reference to FIG. 27 to FIG. 37. Note that that this operation is also principally performed under control of the controller 10 of the banknote pay-in/pay-out device 4.

Banknotes input into the pay-in/pay-out port section 21 include a first banknote (namely a pay-in reject banknote) BL1 that the classification sensors 31 (see FIG. 2) disposed on the front linear path 30*a* of the classification section 100 has determined to be a banknote that cannot be paid in. The pay-in reject banknote BL1 passes from the front linear path 30*a* through the lower curved path 30*c* of the classification section 100, and advances upwards on the rear linear path 30*b*.

The conveyance state detection sensor 33 disposed on the rear linear path 30*b* detects when the leading edge of the pay-in reject banknote BL1 has reached the conveyance state detection sensor 33.

Thereupon, the banknote pay-in/pay-out device 4 switches the conveyance path switching unit 32*b* that is disposed ahead (namely upwards) of the conveyance state detection sensor 33 such that the conveyance destination of the first pay-in reject banknote BL1 is the sorting conveyance path 101.

Then, the conveyance state detection sensor 111 disposed to the rear of the conveyance path switching unit 32*b* detects when the leading edge of the first pay-in reject banknote BL1 has reached the conveyance state detection sensor 111.

Then, after a specific duration has elapsed from this point in time, the banknote pay-in/pay-out device 4 actuates a motor, not illustrated in the drawings. The banknote pay-in/pay-out device 4 rotates the conveyance rollers 50 of the sorting conveyance path 101 such that the conveyance direction of the sorting conveyance path 101 is a direction heading from the front end of the sorting conveyance path 101 toward the rear end of the sorting conveyance path 101.

Figure 27:
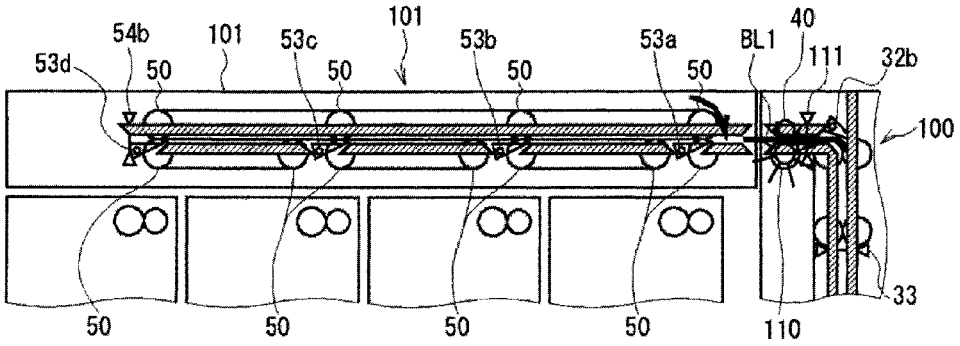
FIG. 27 is a schematic diagram to accompany explanation of temporary retention of pay-in reject banknotes (1) of the fourth exemplary embodiment.

A processing time from detection of the trailing edge of the pay-in reject banknote BL1 until the start of rotation of the conveyance rollers 50 is set as illustrated in FIG. 27. Namely, the processing time is set such that rotation of the conveyance rollers 50 starts immediately prior to the leading edge of the pay-in reject banknote BL1 reaching the foremost conveyance rollers 50 disposed at the front end of the sorting conveyance path 101.

Note that when this is performed, the conveyance path switching units 53 (53*a* to 53*d*) disposed along the sorting conveyance path 101 have already been respectively switched such that the sorting conveyance path 101 is not connected to the banknote storage boxes 26 (26*a* to 26*d*).

In other words, the conveyance path switching units 53 (53*a* to 53*d*) are switched such that the banknote will advance from the front end toward the rear of the sorting conveyance path 101 without entering any of the banknote storage boxes 26.

The conveyance state detection sensor 111 then detects when the trailing edge of the first pay-in reject banknote BL1 has reached the conveyance state detection sensor 111.

After a specific duration has elapsed from this point in time, the banknote pay-in/pay-out device 4 then stops the motor, not illustrated in the drawings, thereby stopping the rotation of the conveyance rollers 50 of the sorting conveyance path 101.

Figure 28:
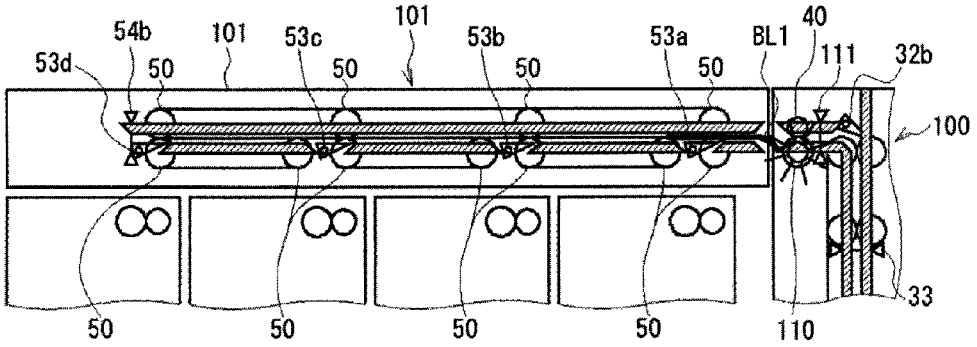
FIG. 28 is a schematic diagram to accompany explanation of temporary retention of pay-in reject banknotes (2) of the fourth exemplary embodiment.

A specific duration from detection of the trailing edge of the pay-in reject banknote BL1 until the rotation of the conveyance rollers 50 is stopped is set as illustrated in FIG. 28. Namely, the specific duration is set such that rotation of the conveyance rollers 50 is stopped just as the pay-in reject banknote BL1 has almost completely entered the sorting conveyance path 101, and the trailing edge of the pay-in reject banknote BL1 has advanced to a position where it is pressed downward by the vaned wheel 110.

As a result, the first pay-in reject banknote BL1 stops at the front end of the sorting conveyance path 101 in a state in which the trailing edge of the pay-in reject banknote BL1 is pressed downward by the vaned wheel 110. The first pay-in reject banknote is thus temporarily retained in the sorting conveyance path 101.

Note that at this stage the classification section 100 goes on to perform classification of the following banknote.

The banknote pay-in/pay-out device 4 then uses the conveyance state detection sensor 33 to detect when the leading edge of a second pay-in reject banknote BL2 has reached the conveyance state detection sensor 33. The banknote pay-in/pay-out device 4 then switches the conveyance path switching unit 32*b* disposed ahead (namely upwards) of the conveyance state detection sensor 33 such that the conveyance destination of the second pay-in reject banknote BL2 is the sorting conveyance path 101.

The banknote pay-in/pay-out device 4 then uses the conveyance state detection sensor 111 disposed ahead (namely to the rear) of the conveyance path switching unit 32*b* to detect when the leading edge of the second pay-in reject banknote BL2 has reached the conveyance state detection sensor 111. After a specific duration has elapsed, the banknote pay-in/pay-out device 4 actuates the motor, not illustrated in the drawings, rotating the conveyance rollers 50 of the sorting conveyance path 101 such that the conveyance destination of the sorting conveyance path 101 is a direction heading from the front end of the sorting conveyance path 101 toward the trailing edge of the sorting conveyance path 101.

The specific duration from detection of the leading edge of the pay-in reject banknote BL2 until the start of rotation of the conveyance rollers 50 is set similarly to for the first banknote. Namely, the specific duration is set such that the rotation of the conveyance rollers 50 starts immediately prior to the leading edge of the pay-in reject banknote BL2 reaching the foremost conveyance rollers 50 disposed at the front end of the sorting conveyance path 101.

Figure 29:
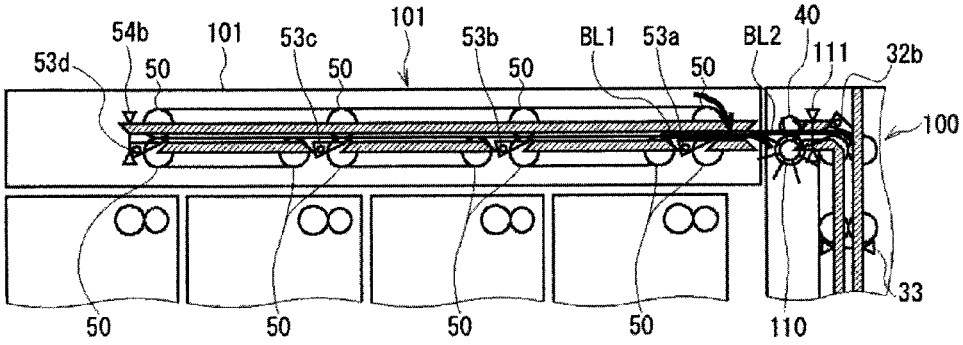
FIG. 29 is a schematic diagram to accompany explanation of temporary retention of pay-in reject banknotes (3) of the fourth exemplary embodiment.

In other words, as illustrated in FIG. 29, the specific duration is set such that rotation of the conveyance rollers 50 starts just as the leading edge portion of the second pay-in reject banknote BL2 advances to a position above and overlapping with a trailing edge portion of the first pay-in reject banknote BL1 that is being pushed downwards by the vaned wheel 110.

As a result, the two pay-in reject banknotes BL1 and BL2 are conveyed in a state in which the leading edge portion of the second pay-in reject banknote BL2 overlaps with the trailing edge portion of the first pay-in reject banknote BL1.

The banknote pay-in/pay-out device 4 then uses the conveyance state detection sensor 111 to detect when the trailing edge of the second pay-in reject banknote BL2 reaches the conveyance state detection sensor 111. After the specific duration has elapsed, the banknote pay-in/pay-out device 4 then stops the motor, not illustrated in the drawings, stopping the rotation of the conveyance rollers 50 of the sorting conveyance path 101.

The specific duration from detection of the trailing edge of the pay-in reject banknote BL2 until the rotation of the conveyance rollers 50 is stopped is set similarly to for the first banknote. Namely, the specific duration is set such that the rotation of the conveyance rollers 50 is stopped just as the pay-in reject banknote BL2 has almost completely entered the sorting conveyance path 101, and the trailing edge of the pay-in reject banknote BL2 has advanced to a position where it is pressed downward by the vaned wheel 110.

Figure 30:
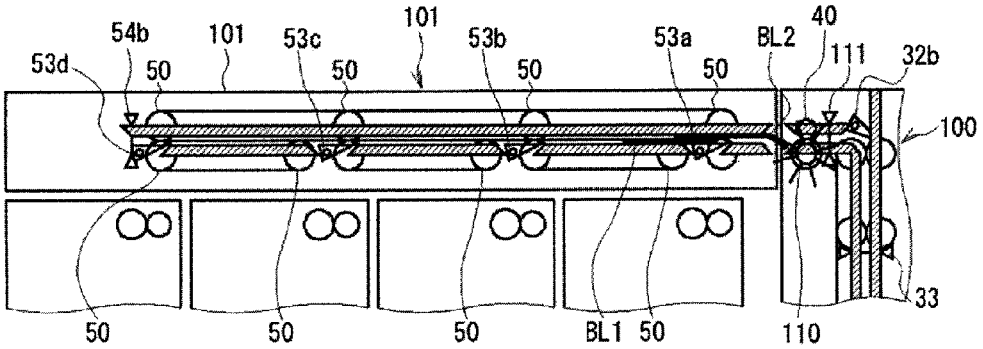
FIG. 30 is a schematic diagram to accompany explanation of temporary retention of pay-in reject banknotes (4) of the fourth exemplary embodiment.

As a result, as illustrated in FIG. 30, the second pay-in reject banknote BL2 stops at the front end of the sorting conveyance path 101 in a state in which the trailing edge of the pay-in reject banknote BL2 is pressed downward by the vaned wheel 110, and the leading edge portion of the pay-in reject banknote BL2 is in a state overlapping with the trailing edge portion of the first pay-in reject banknote BL1.

The first and second pay-in reject banknotes BL1 and BL2 are thereby temporarily retained in the sorting conveyance path 101 in a partially overlapping state.

Figure 31:
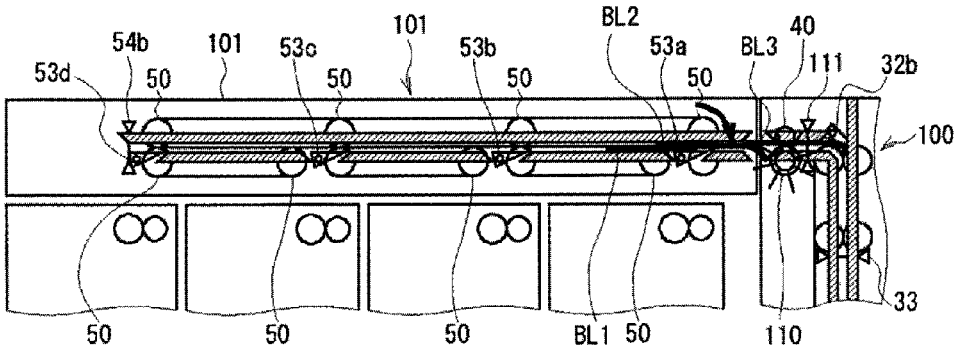
FIG. 31 is a schematic diagram to accompany explanation of temporary retention of pay-in reject banknotes (5) of the fourth exemplary embodiment.
Figure 32:
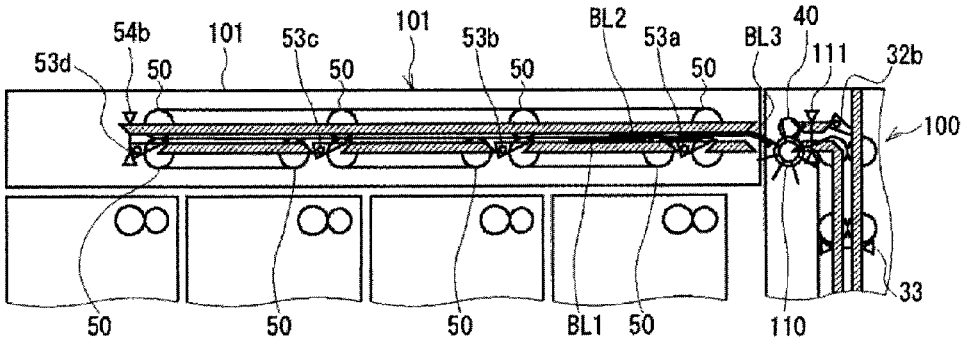
FIG. 32 is a schematic diagram to accompany explanation of temporary retention of pay-in reject banknotes (6) of the fourth exemplary embodiment.

Thereafter, as illustrated in FIG. 31 and FIG. 32, the banknote pay-in/pay-out device 4 temporarily retains banknotes out of the banknotes inserted by the user that have been determined to be pay-in reject banknotes on the sorting conveyance path 101 in a partially overlapping state as described above.

Figure 33:
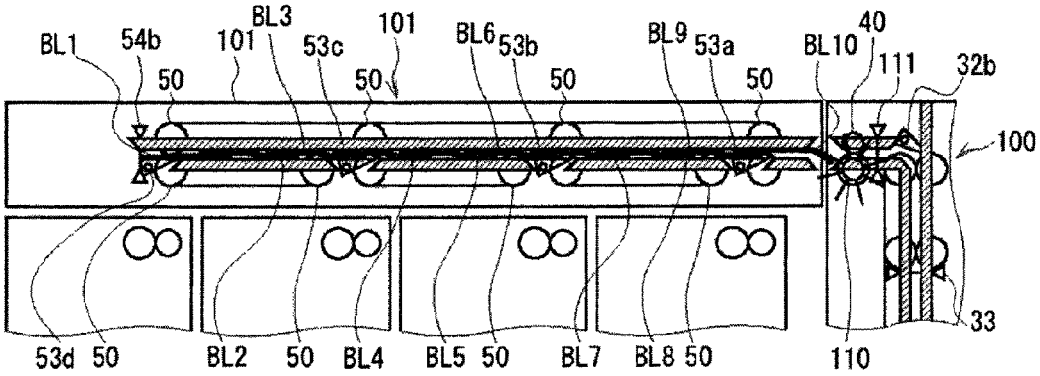
FIG. 33 is a schematic diagram to accompany explanation of temporary retention of pay-in reject banknotes (7) of the fourth exemplary embodiment.

Pay-in reject banknotes are thus temporarily retained on the sorting conveyance path 101. Then, as illustrated in FIG. 33, the number of pay-in reject banknotes that are temporarily retained in the sorting conveyance path 101 reaches the maximum temporarily retainable number of banknotes at a point in time when the leading edge of the first pay-in reject banknote BL1 has reached the conveyance state detection sensor 54*b* disposed at the trailing edge of the sorting conveyance path 101.

When the number of pay-in reject banknotes temporarily retained in the sorting conveyance path 101 thus reaches the maximum temporarily retainable number, or when pay-in counting processing of the banknotes inserted into the safe section 20 is completed before the maximum temporarily retainable number is reached, the banknote pay-in/pay-out device 4 returns the pay-in reject banknotes temporarily retained in the sorting conveyance path 101 to the user.

When this is performed, the banknote pay-in/pay-out device 4 feeds out the pay-in reject banknotes temporarily retained in the sorting conveyance path 101 to the classification section 100, one note at a time.

Explanation is given regarding an example in which ten pay-in reject banknotes BL1 to BL10 are temporarily retained in the sorting conveyance path 101.

Figure 34:
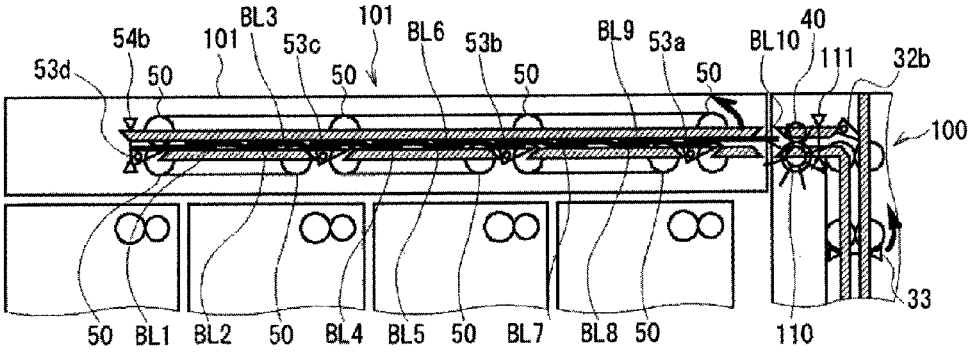
FIG. 34 is a schematic diagram to accompany explanation of temporary retention of pay-in reject banknotes (8) of the fourth exemplary embodiment.

Here, as illustrated in FIG. 34, the banknote pay-in/pay-out device 4 actuates the motor, not illustrated in the drawings, thereby rotating the conveyance rollers 50 of the sorting conveyance path 101 such that the conveyance destination of the sorting conveyance path 101 is the direction heading from the trailing edge of the sorting conveyance path 101 toward the front end of the sorting conveyance path 101 (namely the opposite direction to the direction during temporary retention).

The ten pay-in reject banknotes BL1 to BL10 temporarily retained in the sorting conveyance path 101 thereby advance along the sorting conveyance path 101 toward the front.

Note that when this is performed, the banknote pay-in/pay-out device 4 also uses the motor, not illustrated in the drawings, to rotate the conveyance rollers 40 of the classification section 100 in the opposite direction to the direction during temporary retention.

Moreover, when this is performed, the banknote pay-in/pay-out device 4 also rotates the vaned wheel 110 of the classification section 100 in the opposite direction to the direction during temporary retention so as to release the pressing of the pay-in reject banknotes by the vaned wheel 110.

Figure 35:
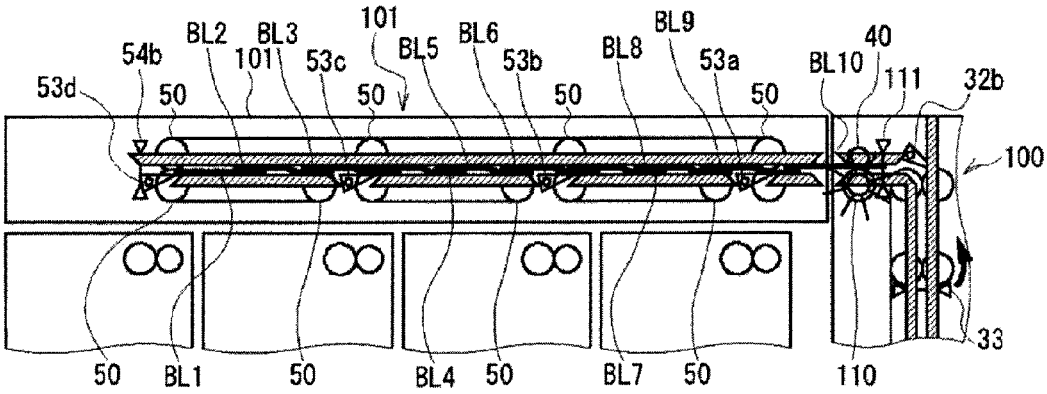
FIG. 35 is a schematic diagram to accompany explanation of temporary retention of pay-in reject banknotes (9) of the fourth exemplary embodiment.

Then, as illustrated in FIG. 35, the banknote pay-in/pay-out device 4 uses the conveyance state detection sensor 111 of the classification section 100 to detect when the leading edge of the tenth pay-in reject banknote (namely the last pay-in reject banknote to be temporarily retained) BL10, that is the leading banknote, has reached the conveyance state detection sensor 111.

A state is thereby reached in which the ninth pay-in reject banknote BL9 advances to a position nipped between the foremost conveyance rollers 50 just as the trailing edge of the tenth pay-in reject banknote BL10 has advanced beyond the foremost conveyance rollers 50 of the sorting conveyance path 101.

The banknote pay-in/pay-out device 4 stops the motor, not illustrated in the drawings, stopping rotation of the conveyance rollers 50 of the sorting conveyance path 101. Note that rotation of the conveyance rollers 40 of the classification section 100 continues as it is when this is performed.

Figure 36:
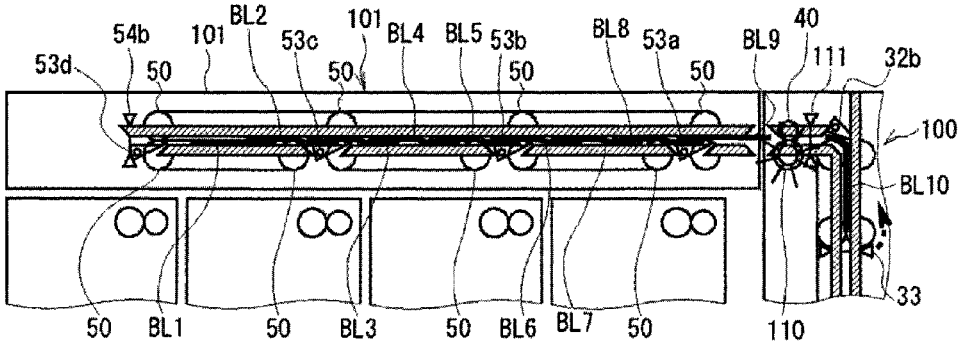
FIG. 36 is a schematic diagram to accompany explanation of temporary retention of pay-in reject banknotes (10) of the fourth exemplary embodiment.

As a result, as illustrated in FIG. 36, the first to the ninth pay-in reject banknotes BL1 to BL9 come to a stop, remaining on the sorting conveyance path 101. However, the tenth pay-in reject banknote BL10 is fed out to the classification section 100 and advances into the classification section 100.

The tenth pay-in reject banknote BL10 is thereby fed out from the sorting conveyance path 101 to the classification section 100.

Figure 37:
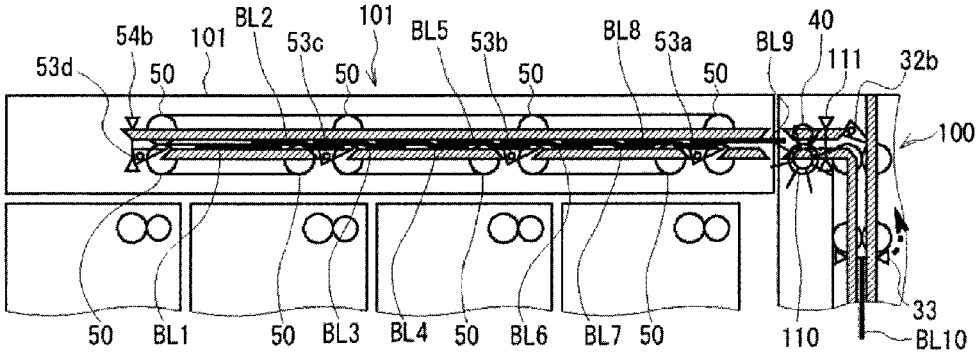
FIG. 37 is a schematic diagram to accompany explanation of temporary retention of pay-in reject banknotes (11) of the fourth exemplary embodiment.

Then, as illustrated in FIG. 37, the banknote pay-in/pay-out device 4 uses the conveyance state detection sensor 33 to detect when the trailing edge of the pay-in reject banknote BL10 has reached the conveyance state detection sensor 33.

When this occurs, the banknote pay-in/pay-out device 4 actuates the motor, not illustrated in the drawings, rotating the conveyance rollers 50 of the sorting conveyance path 101 such that the conveyance destination of the sorting conveyance path 101 is the direction heading from the rear end of the sorting conveyance path 101 toward the front end of the sorting conveyance path 101. The banknote pay-in/pay-out device 4 thereby feeds out the next pay-in reject banknote BL9 from the sorting conveyance path 101 to the classification section 100.

Thereafter, the banknote pay-in/pay-out device 4 similarly feeds out the first to the eighth pay-in reject banknotes BL1 to BL8 to the classification section 100, one note at a time.

The ten pay-in reject banknotes BL1 to BL10 that have been fed into the classification section 100 are replaced in the pay-in/pay-out port section 21 to be returned to the user, similarly to in the first exemplary embodiment.

4-3. Operation and Advantageous Effects

In the configuration described above, in the fourth exemplary embodiment, during temporary retention of plural pay-in reject banknotes inside the sorting conveyance path 101, the respective pay-in reject banknotes are temporarily retained partially overlapping with one another, rather than at a uniform separation to one another.

So doing enables the maximum temporarily retainable number to be increased in comparison to when pay-in reject banknotes are retained at a uniform separation to one another, without altering the length of the sorting conveyance path 101.

Moreover in the fourth exemplary embodiment, similarly to in the first exemplary embodiment, due to utilizing the sorting conveyance path 101 as the pay-in reject banknote temporary retention destination, there is no need to provide a separate dedicated pay-in reject banknote temporary storage box, thereby enabling an increase in cost due to temporarily retaining pay-in reject banknotes to be suppressed to a minimum. An increase in size of the banknote pay-in/pay-out device 4 can also be avoided.

5. Other Exemplary Embodiments

5-1. Other Exemplary Embodiment 1

Note that in the first exemplary embodiment described above, the banknote pay-in/pay-out device 4 is provided inside the safe section 20 that is enclosed by thick steel plates provided inside the ATM 1.

Figure 38:
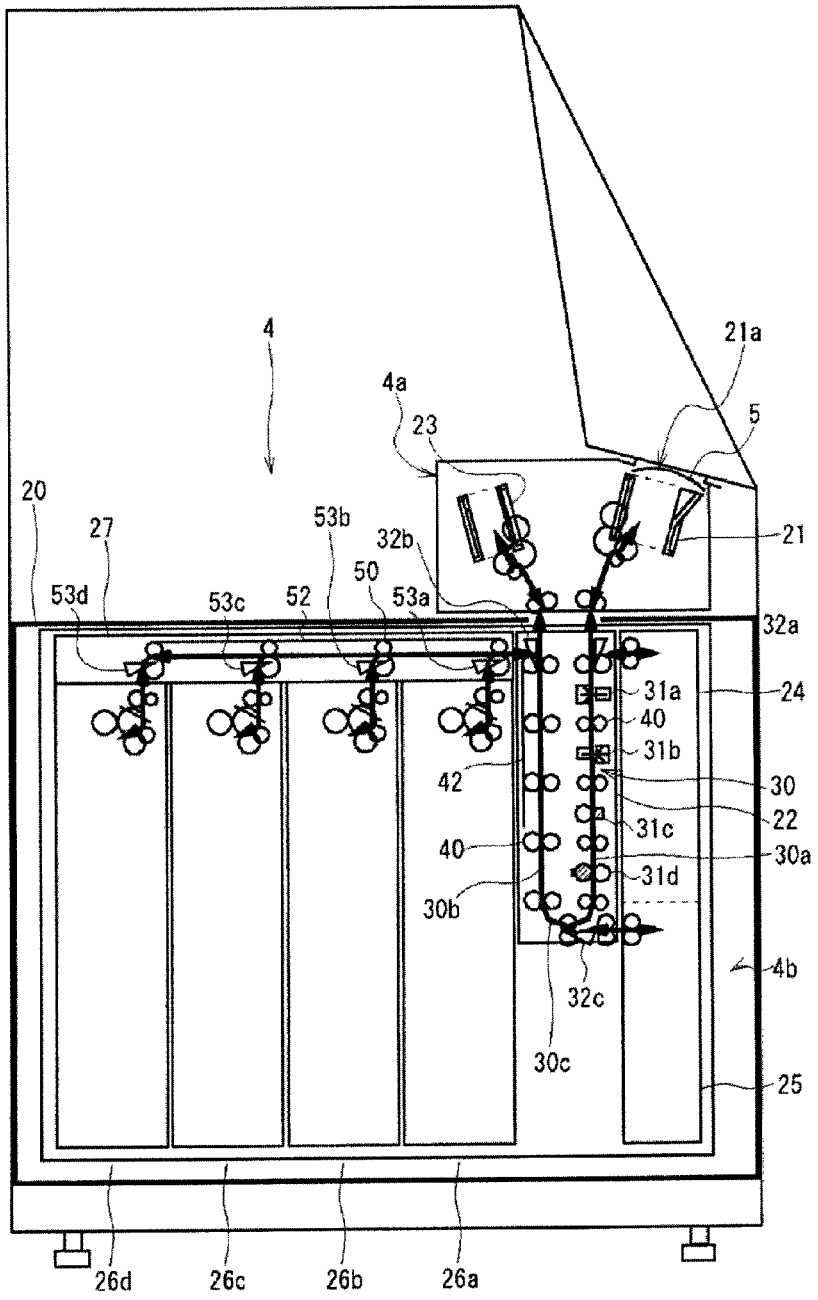
FIG. 38 is a schematic diagram illustrating a configuration of a banknote pay-in/pay-out device of another exemplary embodiment.

There is no limitation thereto, and, for example as illustrated in FIG. 38, the banknote pay-in/pay-out device 4 may be divided into an upper section 4*a* and a lower section 4*b*, with only the lower section 4*b* disposed inside the safe section 20. The upper section 4*a* includes the pay-in/pay-out port section 21 and the temporary holding section 23. The lower section 4*b* includes the classification section 22, the reject box 24, the retrieval box 25, the banknote storage boxes 26 and the sorting conveyance path 27.

Such a configuration is not limited to the first exemplary embodiment, and may also be implemented in the second exemplary embodiment to the fourth exemplary embodiment.

5-2. Other Exemplary Embodiment 2

In the first exemplary embodiment described above, the classification section 22 is configured by the U-shaped conveyance path 30 and the classification sensors 31 disposed along the conveyance path 30.

The sections serving as respective conveyance destinations (the pay-in/pay-out port section 21, the temporary holding section 23, the reject box 24, the retrieval box 25, and the sorting conveyance path 27) are disposed at the periphery of the conveyance path 30 of the classification section 22, so as to be connected to the conveyance path 30 as required.

There is no limitation thereto, and the shape of the conveyance path 30 of the classification section 22, as well as positional relationships between the conveyance path 30 and each of the other sections, may be modified as appropriate according to the specifications of the ATM 1.

5-3. Other Exemplary Embodiment 3

In the fourth exemplary embodiment described above, the vaned wheel 110 is provided at the rear end of the classification section 100, however there is no limitation thereto, and the vaned wheel 110 may be provided at the front end of the sorting conveyance path 101.

5-4. Other Exemplary Embodiment 4

Moreover, in the fourth exemplary embodiment described above, the conveyance state detection sensor 111 is disposed at a specific position in the classification section 100. In the fourth exemplary embodiment, rotation of the conveyance rollers 50 of the sorting conveyance path 101 is started and stopped at a specific timing after detection of a banknote by the conveyance state detection sensor 111.

There is no limitation thereto, and the timing for starting and stopping rotation of the conveyance rollers 50 after detection of a banknote by the conveyance state detection sensor 111 may be modified, and the position of the conveyance state detection sensor 111 may also be modified, within a range enabling similar advantageous effects to those of the fourth exemplary embodiment to be obtained.

5-5. Other Exemplary Embodiment 5

In the first and the fourth exemplary embodiments described above, the sorting conveyance path 27, 101 is utilized as a temporary retention section where pay-in reject banknotes are temporarily retained.

In the second exemplary embodiment, one out of the plural banknote storage boxes 26 (26*a* to 26*d*) is utilized as the temporary retention section where pay-in reject banknotes are temporarily retained. Moreover, in the third exemplary embodiment, the temporary holding section 23 is utilized as the temporary retention section where pay-in reject banknotes are temporarily retained.

There is no limitation thereto, and instead of the sorting conveyance path 27 or the sorting conveyance path 101, the banknote storage boxes 26 or the temporary holding section 23, the banknote pay-in/pay-out device 4 may utilize other locations as the temporary retention section as long as it a location capable of conveying a banknote both toward and away from the classification section 22 or the classification section 100, and capable of temporarily retaining pay-in reject banknotes.

5-6. Other Exemplary Embodiment 6

In the first to the fourth exemplary embodiments described above, the present invention is applied to the banknote pay-in/pay-out device 4 that is provided to the ATM 1, however the present invention is not limited thereto. The present invention may be applied to various devices, as long as it is a device in which, out of banknotes inserted during paying in, pay-in reject banknotes determined to be unsuitable for paying in are temporarily retained.

In the first to the fourth exemplary embodiments described above, the present invention is applied the ATM 1 that serves as an example of a banknote processing machine, however the present invention is not limited thereto. The present invention may be applied to various devices, as long as it is a device provided with a banknote pay-in/pay-out device in which, out of banknotes inserted during paying in, pay-in reject banknotes determined to be unsuitable for paying in are temporarily retained.

5-7. Other Exemplary Embodiment 7

The present invention is not limited to the first to the fourth exemplary embodiments described above or to the other exemplary embodiments described above. Namely, the present invention is also applicable to exemplary embodiments arrived at through an appropriate combination of parts of, or all of, the first to fourth exemplary embodiments described above and the other exemplary embodiments described above, and to exemplary embodiments arrived at by extracting parts thereof.

The present invention may be widely employed in devices such as ATMs in which, out of banknotes inserted during paying in, pay-in reject banknotes determined to be unsuitable for paying in are returned to the user.

The invention claimed is:

1. A banknote processing device, comprising:

a pay-in/pay-out port section that includes a pay-in port and a pay-out port for banknotes;

a classification section that classifies banknotes;

a banknote storage box that, out of banknotes inserted into the pay-in/pay-out port section, stores any normal banknotes determined by the classification section to be normal; and a temporary retention section that is provided separately to the pay-in/pay-out port section, and that, out of banknotes inserted into the pay-in/pay-out port section, temporarily retains any pay-in reject banknotes determined by the classification section to be unsuitable for paying in, the temporary retention section being a conveyance path for conveying banknotes, wherein any pay-in reject banknotes that the classification section has determined to be unsuitable for paying in are temporarily retained in the temporary retention section prior to being returned to the pay-in/pay-out port section to be returned to a user.

2. The banknote processing device of claim 1, further comprising, a temporary holding section that temporarily stores the normal banknotes prior to storing the normal banknote in the banknote storage box, wherein the classification section comprises a switching unit that switches a banknote conveyance destination either to the temporary holding section or to the temporary retention section, and the switching unit switches the banknote conveyance destination such that normal banknotes are conveyed to the temporary holding section, and any pay-in reject banknotes are conveyed to the temporary retention section.

3. The banknote processing device of claim 2, wherein the conveyance path for conveying banknotes is a sorting conveyance path, the classification section comprises:

a further conveyance path connected to the pay-in/pay-out port section and the temporary holding section and linking between the pay-in/pay-out port section and the temporary holding section; and a classification sensor that is disposed partway along the further conveyance path and that classifies banknotes passing along the further conveyance path, and the switching unit is disposed on the further conveyance path downstream of the classification sensor, and switches the conveyance destination such that the banknote conveyance destination is the temporary holding section when a banknote is determined by the classification sensor to be the normal banknote, and switches the conveyance destination such that the banknote conveyance destination is the temporary retention section when a banknote is determined to be a pay-in reject banknote.

4. The banknote processing device of claim 3, further comprising a plurality of the banknote storage boxes that store the normal banknotes and that are provided so as to respectively store banknotes by denomination, wherein the sorting conveyance path links between the plurality of banknote storage boxes and the classification section, and is connected to the vicinity of a connection location-of the further conveyance path of the classification section to the temporary holding section.

5. The banknote processing device of claim 2, wherein when the number of pay-in reject banknotes being temporarily retained in the temporary retention section reaches a maximum number retainable in the temporary retention section, or when conveyance has been completed for every banknote inserted into the pay-in/pay-out port section either to the temporary holding section or to the temporary retention section, any pay-in reject banknotes temporarily retained in the temporary retention section are returned to the pay-in/pay-out port section to be returned to a user.

6. The banknote processing device of claim 4, wherein the sorting conveyance path includes a conveyance state detection sensor which detects a conveyance state of a banknote on the sorting conveyance path, and wherein by temporarily utilizing the sorting conveyance path as the temporary retention section, any pay-in reject banknotes are temporarily retained in the sorting conveyance path prior to being returned to the pay-in/pay-out port section to be returned to a user.

7. The banknote processing device of claim 6, wherein a plurality of pay-in reject banknotes are retained on the sorting conveyance path with uniform intervals between one another.

8. The banknote processing device of claim 6, wherein a plurality of pay-in reject banknotes are retained on the sorting conveyance path partially overlapping with one another.

9. A banknote processing device, comprising:

a pay-in/pay-out port section that includes a pay-in port and a pay-out port for banknotes;

a classification section that classifies banknotes;

a plurality of the banknote storage boxes that are provided so as to respectively store banknotes by denomination, each of the plurality of the banknote storage boxes, out of banknotes inserted into the pay-in/pay-out port section, storing any normal banknotes determined by the classification section to be normal; and a temporary retention section that is provided separately to the pay-in/pay-out port section, and that, out of banknotes inserted into the pay-in/pay-out port section, temporarily retains any pay-in reject banknotes determined by the classification section to be unsuitable for paying in, a temporary holding section that temporarily stores the normal banknotes prior to storing the normal banknote in the plurality of the banknote storage boxes, a sorting conveyance path that links between the plurality of banknote storage boxes and the classification section, the sorting conveyance path being connected to the vicinity of a connection location-of the further conveyance path of the classification section to the temporary holding section, wherein the pay-in reject banknotes are temporarily retained in the temporary retention section prior to being returned to the pay-in/pay-out port section to be returned to a user, the classification section comprises:

a conveyance path that is connected to the pay-in/pay-out port section and the temporary holding section and that links between the pay-in/pay-out port section and the temporary holding section;

a classification sensor that is disposed partway along the conveyance path and that classifies banknotes passing along the conveyance path, and a switching unit that switches a conveyance destination such that the banknote conveyance destination is the temporary holding section when a banknote is determined by the classification sensor to be a normal banknote and the banknote conveyance destination is the temporary retention section when a banknote is determined by the classification sensor to be a pay-in reject banknote, the switching unit being disposed on the conveyance path downstream of the classification sensor, and in addition to the pay-in/pay-out port section, the temporary holding section, and the sorting conveyance path, a reject box and a retrieval box are connected to the conveyance path of the classification section, the reject box storing pay-out reject banknotes determined by the classification section to be unsuitable for paying out during paying out of banknotes stored in the banknote storage box, the retrieval box housing any banknotes left behind in the pay-in/pay-out port section.

10. A banknote processing device, comprising:

a pay-in/pay-out port section that includes a pay-in port and a pay-out port for banknotes;

a classification section that classifies banknotes;

a plurality of banknote storage boxes that, out of banknotes inserted into the pay-in/pay-out port section, stores any normal banknotes determined by the classification section to be normal; and a first temporary section that is provided separately to the pay-in/pay-out port section, wherein any one of the plurality of banknote storage boxes is set as a second temporary section, one of the first temporary section and the second temporary section is set as a temporary retention section, and another of the first temporary section and the second temporary section is set as a temporary holding section, the temporary holding section temporarily holds the normal banknotes prior to storing the normal banknotes in the rest of the plurality of banknote storage boxes, and the temporary retention section temporarily retains any pay-in reject banknotes determined by the classification section to be unsuitable for paying in out of banknotes inserted into the pay-in/pay-out port section, any pay-in reject banknotes being temporarily retained in the temporary retention section prior to being returned to the pay-in/pay-out port section to be returned to a user.

11. The banknote processing device of claim 10, wherein the classification section comprises a switching unit that switches a banknote conveyance destination either to the temporary holding section or to the temporary retention section, the switching unit switching the banknote conveyance destination such that the normal banknotes are conveyed to the temporary holding section, and any pay-in reject banknotes are conveyed to the temporary retention section.

12. The banknote processing device of claim 10, wherein when the number of pay-in reject banknotes being temporarily retained in the temporary retention section reaches a maximum number retainable in the temporary retention section, or when conveyance has been completed for every banknote inserted into the pay-in/pay-out port section either to the temporary holding section or to the temporary retention section, any pay-in reject banknotes temporarily retained in the temporary retention section are returned to the pay-in/pay-out port section to be returned to a user.

* * * * *